US006641246B2

(12) United States Patent
Endo et al.

(10) Patent No.: US 6,641,246 B2
(45) Date of Patent: Nov. 4, 2003

(54) DETECTION OF NON-OPERATING NOZZLE BY LIGHT BEAM PASSING THROUGH APERTURE

(75) Inventors: Hironori Endo, Nagano-ken (JP); Hiroshi Asawa, Nagano-ken (JP); Hitoshi Matsumoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/155,990

(22) Filed: May 29, 2002

(65) Prior Publication Data

US 2002/0186268 A1 Dec. 12, 2002

Related U.S. Application Data

(63) Continuation-in-part of application No. 09/789,546, filed on Feb. 22, 2001.

(30) Foreign Application Priority Data

Feb. 23, 2000 (JP) ..... 2000-45588(P)
Jun. 21, 2000 (JP) ..... 2000-186049(P)

(51) Int. Cl.[7] ..... B41J 29/393
(52) U.S. Cl. ..... 347/19; 347/81; 250/573
(58) Field of Search ..... 347/19, 81; 250/222.1, 250/222.2, 573

(56) References Cited

U.S. PATENT DOCUMENTS 3,599,003 A * 8/1971 Price et al. ..... 382/314
5,430,306 A * 7/1995 Ix ..... 250/573
5,963,225 A * 10/1999 Sugiyama ..... 347/19
6,305,777 B1 * 10/2001 Lee ..... 347/19
6,350,006 B1 * 2/2002 Muller et al. ..... 347/19
6,517,183 B2 * 2/2003 Bruch et al. ..... 347/19
6,527,358 B2 * 3/2003 Kuriyama et al. ..... 347/19
6,548,803 B1 * 4/2003 Nakata et al. ..... 250/216

FOREIGN PATENT DOCUMENTS

JP 410119307 A * 5/1998 ..... B41J/2/175

OTHER PUBLICATIONS

Fan G.J., "Phase Detection of Ink Jet Droplets", Aug. 1973, IBM TDB, vol. 16, No. 3.*
Mendee et al., "Light Sensor for Ink Droplets", Feb. 1974, IBM TDB, vol. 16, No. 9.*
Chan W.H. et al., "Feedback for Synchronized Pressure Jet Using Optical Sensor", May 1974, IBM TDB, vol. 16, No. 12.*
Kuhn et al., "Ink Drop Velocity Measurement via Coded Plates and Photodetectors", Mar. 1975, IBM TDB, vol. 17, No. 10.*

(List continued on next page.)

*Primary Examiner*—Judy Nguyen
*Assistant Examiner*—Blaise Mouttet
(74) *Attorney, Agent, or Firm*—Oblon, Spivak, McClelland, Maier & Neustadt, P.C.

(57) ABSTRACT

The object is to provide a technique whereby a non-operating nozzle can be detected with higher accuracy. The present invention resides in a printer for printing images by ejecting ink droplets from a plurality of nozzles, wherein an optical path in which light from a light-emitting element 40*a* for emitting light is focused by a first focusing element 41, allowed to pass through a focusing aperture 43*a* that is substantially circular and smaller than the area illuminate by the light, and transmitted through the focusing aperture 43*a* to a light-receiving element 40*b* for receiving light is laid out according to a configuration in which an intersection is formed with the path described by the ink droplets ejected by the nozzles. The light-emitting element 40*a* is energized and caused to emit light. The nozzles are actuated and ink droplets are ejected in the direction of a space in which the intensity of light is greater than a prescribed level and which is part of the optical path between the focusing aperture 43*a* and the light-receiving element 40*b*. A non-operating nozzle is then detected based on the fact that the light received by the light-receiving element 40*b* is blocked by the ink droplets thus ejected.

26 Claims, 23 Drawing Sheets

OTHER PUBLICATIONS

Arnold, "Raster Scan Control for an Ink Jet Printer", Sept. 1976, IBM TDB, vol. 19, No. 4.*

No Author Listed, "Dual Lambda Sensor Control for Aspirated Ink Jet Printers", Oct. 1981, IBM TDB, vol. 24, No. 5.*

No Author Listed, "Drop Detector System", Dec. 1980, IBM TDB, vol. 23, No. 7A.*

Gordon McComb, The Laser Cookbook: 88 Practical Projects, 1988, McGraw–Hill, pp. 27–44.*

* cited by examiner

DETECTION OF NON-OPERATING NOZZLE BY LIGHT BEAM PASSING THROUGH APERTURE

BACKGROUND OF THE INVENTION

1. Field of the Invention

The present invention relates to a technique for inspecting inkjet nozzles to detect a non-operating nozzle.

2. Description of the Related Art

In an ink-jet printer, ink droplets are ejected from a plurality of nozzles provided at a print head. Some of the nozzles occasionally get clogged and are rendered incapable of ejecting ink droplets because of an increase in ink viscosity, formation of gas bubbles in an ink passage, and other factors. Nozzle clogging produces images with missing dots and has an adverse effect on image quality. Nozzle inspection is therefore desired to detect a non-operating nozzle. Nozzle inspection will also be referred to herein as "dot loss inspection."

Numerous methods are used to inspect the nozzles of ink-jet printers, and light-based inspection is one such method. In this method, light is emitted by a light-emitting element toward a light-receiving element, ink droplets are sequentially ejected from the nozzles of the print head in the direction of this light, and the operating state of each nozzle is determined based on whether the light is actually blocked by the ink droplets ejected from the nozzles. In this type of inspection, light is focused with a lens.

Because light is focused by a lens, the thickness of the light beam is at its minimum at a certain point on the optical path and increases in the direction away from this point. For this reason, inspecting conditions differ greatly for the inspected nozzles disposed in the vicinity of the location (beam waist) at which the light beam has minimal thickness and the inspected nozzles disposed farther away from the beam waist because of their position on the print head.

A technique featuring two parallel laser beams whose beam waists are shifted along the optical path is disclosed in JPA 10-119307 as a means of addressing these problems. According to this technique, each of the two laser beams is used in nozzle inspection, and the plurality of nozzles being examined is divided between the two beams of laser light. As a result, the nozzles are inspected under more-uniform conditions than that when a single beam of laser light is used. However, this technique still fails to adequately resolve the above-described variations in the inspecting conditions along the optical axis of laser light.

SUMMARY OF THE INVENTION

Accordingly, an object of the present invention, is to provide a technique whereby a non-operating nozzle can be detected with higher accuracy.

In order to attain at least part of the above and related objects of the present invention, there is provided a printer for printing images by ejecting ink droplets from a plurality of nozzles. The printer comprises a print head having a plurality of nozzles; and a sensor including a light-emitting element configured to emit detection light which has a substantially circular cross-section and a light-receiving element configured to receive the detection light, and configured to inspect operation of a nozzle by determining whether the detection light has been blocked by the ink droplets ejected by the nozzle. The sensor further comprises a first condensing element configured to condense the detection light, and an apertured element having a substantially circular aperture for the detection light. The aperture has a size of a same order as the cross-section of the detection light. The detection light intersects an ejecting path of the ink droplets at an exit side of the apertured element and the first condensing element.

In the printer in accordance with the present invention, a light-emitting element, a first condensing, an apertured element and a light-receiving element are provided. The light-emitting element is configured to emit detection light. The first condensing element is configured to condense the detection light. The apertured element having an aperture for the detection light. The light-receiving element is configured to receive the detection light after the detection light intersects a path of the ink droplets ejected by a nozzle. Then the detection light is emitted from the light-emitting element. Ink droplets are ejected from a nozzle. A non-operating nozzle is detected by determining whether the detection light received by the light-receiving element has been blocked by the ink droplets.

Adopting such an arrangement allows the light beam for detecting ink droplets to be constricted through the aperture. At the same time, the narrowest portion of the light beam can be expanded because of a reduction in the angle at which the light is focused. In other words, the thickness of the light beam can be made more uniform along the optical axis. It is therefore possible to reduce variations in the inspecting conditions along the optical axis of the light beam and to inspect the ejection of ink droplets with higher accuracy.

The apertured element may comprise a regular polygonal aperture having four or more angles. These apertures make the cross-section of the light substantially circular. It is more preferable that the apertured element comprises the regular polygonal aperture having six or more angles. Such aperture makes the cross-section of the light nearer circular.

The apertured element is preferably disposed at an exit side of the first condensing element. Minute ink droplets are scattered when an ink droplet is ejected in inspection. But adopting the above-described arrangement allows the scattered ink droplets to be blocked by the apertured element, and makes it less likely that the condensing element will be contaminated. The first condensing element may be disposed at an exit side of the aperture of the apertured element.

The sensor preferably further comprises an angle-adjusting element configured to adjust a direction of emission of the detection light. This allows the direction of the detection light to be adjusted for more-uniform conditions for inspecting the ejection of ink droplets by each nozzle.

The sensor preferably further comprises a position-adjusting element configured to adjust a position of the light-emitting element in a direction intersecting the direction of emission of the detection light. Such an arrangement allows the position of the light-receiving element to be adjusted such that the light-receiving element can accurately receive light when the position of the light emitting element has the deviation.

When the plurality of nozzles are disposed on a same nozzle plane of the print head, the angle-adjusting element is preferably configured to adjust the direction of emission of the detection light within a plane perpendicular to the nozzle plane. Adopting this arrangement allows the direction of emission of the detection light to be adjusted such that the optical axis remains parallel to the nozzle plane.

The angle-adjusting element preferably adjusts the direction of emission of the detection light about an axis intersecting an optical path of detection light within confines of the aperture. Adopting this arrangement allows the center position of the detection light in the aperture to remain constant when the direction of emission of the detection light is adjusted.

The sensor preferably further comprises a first ink mist screen having a first aperture for the detection light. The first ink mist screen is disposed at an exit side of the first condensing element and the apertured element, and divides a first area including the light-emitting element, the first condensing element, and the apertured element, and a second area in which the ink droplets are ejected in a direction of an optical path of the detection light.

Adopting this arrangement allows the first ink mist screen to prevent the light-emitting element or the condensing element from the deposition of the ink mist produced during the ejection of ink droplets by the nozzles. The light-emitting element and first ink mist screen are therefore less likely to suffer reduced performance, and the ejection of ink droplets can be inspected with consistent accuracy when the sensor is operated for a long time.

The printer preferably comprises a plurality of first ink mist screens. The first apertures of the first ink mist screens should be made as small as possible to reduce contamination with ink mist, but must still have sufficient radius to be able to transmit light. For this reason, the apertures cannot be made smaller than a certain size. Adopting this arrangement allows the size of the first apertures to be kept sufficiently large to transmit rectilinearly propagating light, and at the same time causes the ink mist carried by the gas flow to settle down between the first ink mist screens or to deposit on the structures between the first ink mist screens, preventing this mist from reaching the light-emitting element or first condensing element.

The sensor preferably further comprises a second condensing element disposed at an exit side of the first condensing element and the apertured element. The second condensing element having a light reception region with a prescribed surface area, and focuses the detection light received in the light reception region. The detection light intersects an ejecting path of the ink droplets at an incident side of the second condensing element.

The result is that even when light diverges from the initially intended emission direction due to a misalignment, the light beam can still be focused by the second condensing element, refracted, and directed toward the light-receiving element as long as the illumination position falls within the light reception range of the second condensing element. Consequently, there is only a slight chance that the ability of the light-receiving element to receive light will be adversely affected, and the inspecting function cannot be easily compromised even when emitted light deviates from the intended direction.

The sensor further preferably comprises a second ink mist screen having a second aperture for the detection light. The second ink mist screen is disposed at an exit side of the first condensing element and the apertured element, and divides a first area including the light-receiving element and the second condensing element, and a second area in which the ink droplets are ejected in a direction of an optical path of the detection light.

Adopting this arrangement allows the second ink mist screen to prevent ink mist from depositing on the light-receiving element or second condensing element. The light-receiving element and second ink mist screen are therefore less likely to suffer reduced performance, and the ejection of ink droplets can be inspected with consistent accuracy during an extended operation.

The printer preferably includes a plurality of second ink mist screens. As with the case in which a plurality of first ink mist screens are provided, adopting this arrangement can be effective for preventing ink mist from reaching the light-receiving element or second condensing element.

The light-emitting element is preferably mounted on a base member such that a vertical angle of the detection light can be adjusted, and the light-receiving element is preferably mounted on the base member to be able to move horizontally. The light-emitting element and the light-receiving element may share the base member and also may have it independently. The printer is preferably further comprises a first fixing element fixing the light-emitting element to the base member at an adjusted angle; and a second fixing element fixing the light-receiving element to the base member at a prescribed horizontal movement position.

In this case, the light-emitting element is preferably mounted on the base member such that the vertical angle of the detection light can be adjusted about a fulcrum shaft formed in a horizontal direction. The first fixing element preferably comprises a first tightening screw for preventing the light-emitting element from rotating about the fulcrum shaft.

According to a preferred embodiment, the light-emitting element preferably has a hyperbolic slit centered around the fulcrum shaft, and is configured such that the first tightening screw is fastened to the base member via the hyperbolic slit.

In this case, a first metal plate member is preferably further disposed between the first ztightening screw and the light-emitting element provided with the hyperbolic slit; so that tightening stress produced by the first tightening screw is transmitted to the light-emitting element via the first metal plate member; and rotation of the first tightening screw is prevented from reaching the light-emitting element.

According to a preferred means for implementing this concept, the first metal plate member preferably has a pawl, the pawl is configured to be hooked to part of the base member, and prevents the first metal plate member from rotating during the fastening of the first tightening screw.

In addition, the fulcrum shaft is formed at a position in which an axis of the fulcrum shaft intersects the aperture of the apertured element.

A slide mechanism is preferably formed between the light-receiving element and the base member, the slide mechanism has a groove formed in the horizontal direction and a protrusion configured to slide inside the groove. The light-receiving element is preferably mounted by means of the slide mechanism to be able to move horizontally in relation to the base member.

In this case, the protrusion is preferably formed at two locations set apart from each other.

According to a preferred embodiment, the light-receiving element preferably further comprises a rectilinear slit. A second tightening screw as the second fixing element is fastened to the base member by means of the rectilinear slit.

A second metal plate member is preferably further disposed between the second tightening screw and the light-receiving element having the rectilinear slit, so that tightening stress produced by the second tightening screw is transmitted to the light-receiving element via the second metal plate member; and rotation of the second tightening screw is prevented from reaching the light-receiving element.

According to a preferred means for implementing this concept, the second metal plate member preferably has a pawl. The pawl is configured to be hooked to part of the base member, and prevents the second metal plate member from rotating during the fastening of the second tightening screw.

In the printer thus configured, a sensor composed of an optical unit is disposed along the travel path of the print head, and ejecting conditions are inspected for the ink droplets ejected by the nozzles of the print head. In this sensor, the light-emitting element, which is configured to project the detection light, and the light-receiving element, which is configured to receive the detection light from the light-emitting element, are mounted on common base members. The light-emitting element is designed such that the vertical angle of the detection light projected by the light-emitting element can be adjusted. The light-receiving element is designed to allow for horizontal movement.

Consequently, the optical axis of the detection light from the light-emitting element to the light-receiving element can be readily aligned by adjusting the vertical angle on the side of the light-emitting element, and the horizontal position on the side of the light-receiving element. The optically adjusted light-emitting element can be fixed to the corresponding base member by the first fixing element. The light-receiving element can be fixed to the corresponding base member by the second fixing element.

In this case, a tightening screw is prepared as the first fixing element. The light-emitting element set to a prescribed angle in the vertical direction is fixed to the corresponding base member by the tightening screw. According to the preferred embodiment described above, the light-emitting element is provided with a hyperbolic slit centered around a fulcrum shaft formed in the horizontal direction, and the tightening screw is fastened to the base member via the hyperbolic slit. The light-emitting element can thus be readily fixed to the base member in a state in which a prescribed vertical angle is established.

A slide mechanism is formed between the light-receiving element and the corresponding base member by combining a groove formed in the horizontal direction and protrusion designed to slide inside this groove. This arrangement makes it easier to finely adjust the horizontal position of the light-receiving element in relation to the base member. In this case, the light-receiving element can be prevented from oscillating in the horizontal direction and optical adjustments can be facilitated by adopting an arrangement in which protrusion sliding inside a groove are formed at two locations set apart from each other.

Similarly, a tightening screw is prepared as the second fixing element for fixing the light-receiving element to the base member, and the light-receiving element disposed at a prescribed horizontal position is fixed to the base member by the tightening screw. According to the preferred embodiment described above, the light-receiving element is provided with a rectilinear slit, and the tightening screw is fastened to the base member through the slit. The light-receiving element can thus be readily fixed to the base member while kept at a prescribed horizontal position.

It is also possible to adopt an embodiment in which a first metal plate member is interposed between the light-emitting element and the tightening screw serving as the first fixing element, a second metal plate member is interposed between the light-receiving element and the tightening screw serving as the second fixing element, and the two metal plate members are provided with pawls for hooking with part of the base member and preventing rotation from occurring during the fastening of the tightening screws. According to this embodiment, the light-emitting element and light-receiving element can be prevented from shifting and can be securely fixed to the corresponding base members when the light-emitting element and light-receiving element are optically adjusted and fixed by the tightening screws.

The present invention can be worked as the following embodiments.

(1) Printer or print controller (2) Printing method or print control method (3) Computer program for operating the aforementioned device or method (4) Storage medium for storing the computer program for operating the aforementioned device or method (5) Data signals implemented as part of a carrier wave and designed to contain a computer program for operating the aforementioned device or method These and other objects, features, aspects, and advantages of the present invention will become more apparent from the following detailed description of the preferred embodiments with the accompanying drawings.

DESCRIPTION OF THE PREFERRED EMBODIMENTS

Embodiments of the present invention will be described in the following sequence.

A. First Embodiment

A-1. Overall Device Structure

A-2. Structure of Dot Loss Sensor

A-3. Dot Loss Inspecting method

A-4. Merits of First Embodiment

A-5. Modification of First Embodiment

B. Second Embodiment

B-1. Device Structure

B-2. Merits of Second Embodiment

B-3. Modification of Second Embodiment

C. Third Embodiment

C-1. Device Structure

C-2. Merits of Third Embodiment

D. Fourth Embodiment

D-1. Device Structure

D-2. Merits of Fourth Embodiment

D-3. Modification of Fourth Embodiment

E. Fifth Embodiment

F. Other

A. First Embodiment

A-1. Overall Device Structure

Figure 1:
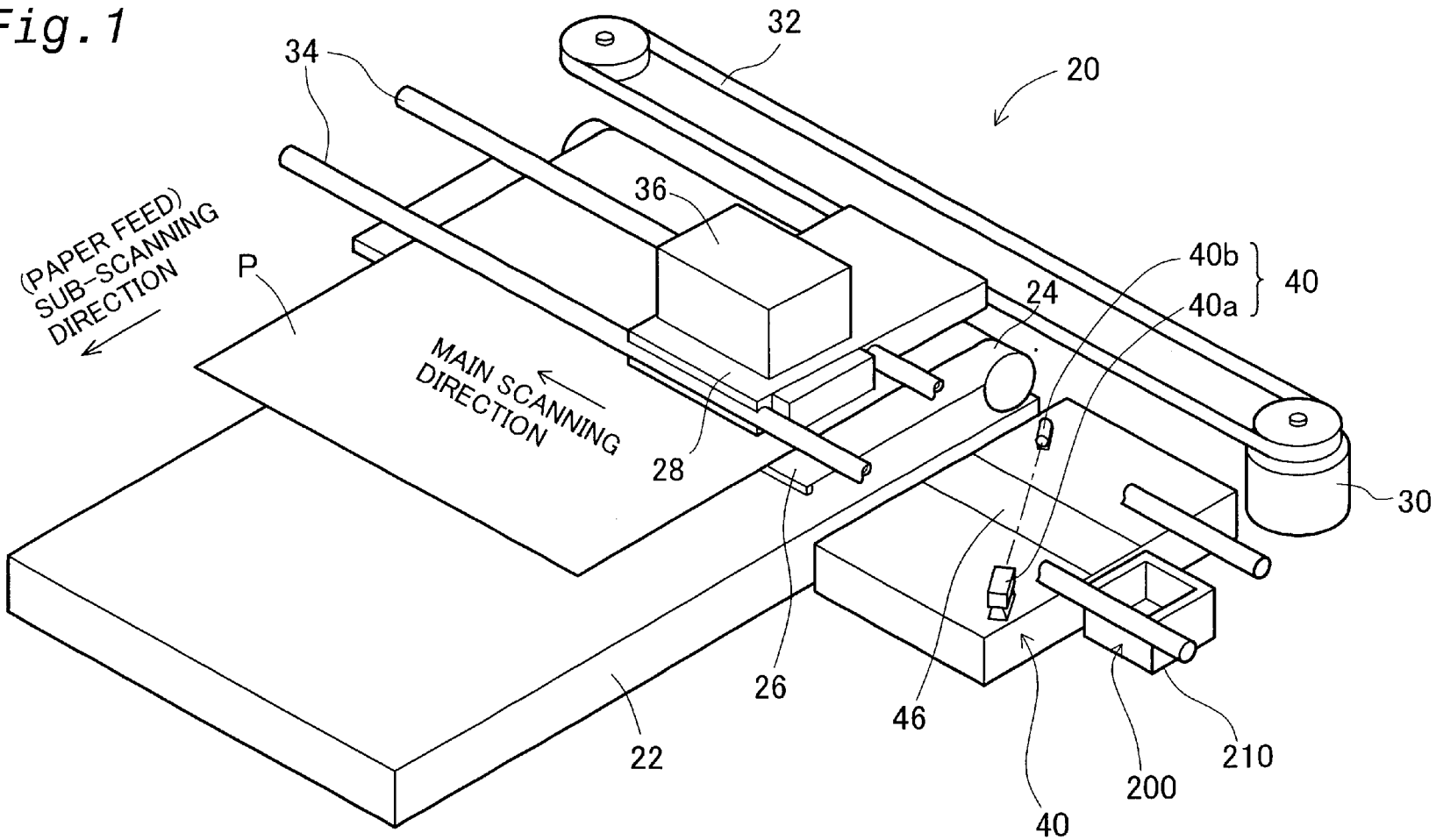
FIG. 1 is a schematic perspective view depicting the structure of the principal components constituting a color ink-jet printer 20 as an embodiment of the present invention.

FIG. 1 is a schematic perspective view depicting the structure of the principal components constituting a color ink-jet printer 20 as an embodiment of the present invention. The printer 20 comprises a paper stacker 22, a paper feed roller 24 driven by a step motor (not shown), a platen plate 26, a carriage 28, a step motor 30, a traction belt 32 driven by the step motor 30, and guide rails 34 for the carriage 28. A print head 36 provided with a plurality of nozzles is mounted on the carriage 28.

Printing paper P is retrieved from the paper stacker 22 by the paper feed roller 24 and transported across the surface of the platen plate 26. This direction will be referred to as "the sub-scanning direction." The carriage 28 is pulled by the traction belt 32, which is itself driven by the step motor 30, and is propelled along the guide rails 34 in the direction perpendicular to the sub-scanning direction. The direction perpendicular to the sub-scanning direction will be referred to as "the main scanning direction." The print head 36 prints images on the printing paper P on the platen plate 26 as a result of main scanning. The area on the platen plate 26 where images are printed will be referred to as "the printing area."

A dot loss sensor 40 and a cleaning mechanism 200 are provided outside the printing area (on the right in FIG. 1). In FIG. 1, only the head cap 210 of the cleaning mechanism 200 is shown while the other parts of the mechanism are omitted. The area containing the dot loss sensor 40 and head cap 210 (this area is part of the route for moving the print head 36 on the guide rails 34 in the main scanning direction) will be referred to as "a standby area" to distinguish it from the printing area.

The dot loss sensor 40 has a waste ink reservoir 46 disposed facing the two guide rails 34. The waste ink reservoir 46 is designed to receive the ink droplets ejected from the print head 36 during the ejecting inspection of ink droplets. The dot loss sensor 40 has a light-emitting element 40*a* and a light-receiving element 40*b*. The light-emitting element 40*a* and light-receiving element 40*b* are disposed on opposite sides of the waste ink reservoir 46. The light-emitting element 40*a* emits laser light, and the light-receiving element 40*b* receives this laser light. The light-receiving element 40*b* is a device whose output varies with the luminous energy received, and may, for example, be a photodiode. The laser light emitted by the light-emitting element 40*a* and received by the light-receiving element 40*b* makes an angle of about 26 degrees with the sub-scanning direction and traverses the space between the waste ink reservoir 46 and the two guide rails 34. Since this laser light is used to inspect the ejection of ink droplets in the area above the waste ink reservoir 46, the area above the waste ink reservoir 46 (which is part of the region through which the print head 36 moves on the guide rails 34 in the main scanning direction) will be referred to as "the inspection area." Described below are a dot loss inspecting method and a detailed structure of the dot loss sensor 40. Other constituent elements of the dot loss sensor 40 are omitted from FIG. 1.

The head cap 210 is an airtight cap that covers the print head 36 and prevents the ink in the nozzles from drying up when no printing is performed. When the nozzles become clogged, the print head 36 is covered with the head cap 210 for nozzle cleaning. Since the nozzle cleaning is performed in the area above the head cap 210 (which is part of the region through which the print head 36 moves on the guide rails 34 in the main scanning direction), the area above the head cap 210 will be referred to as "the cleaning area."

Figure 2:
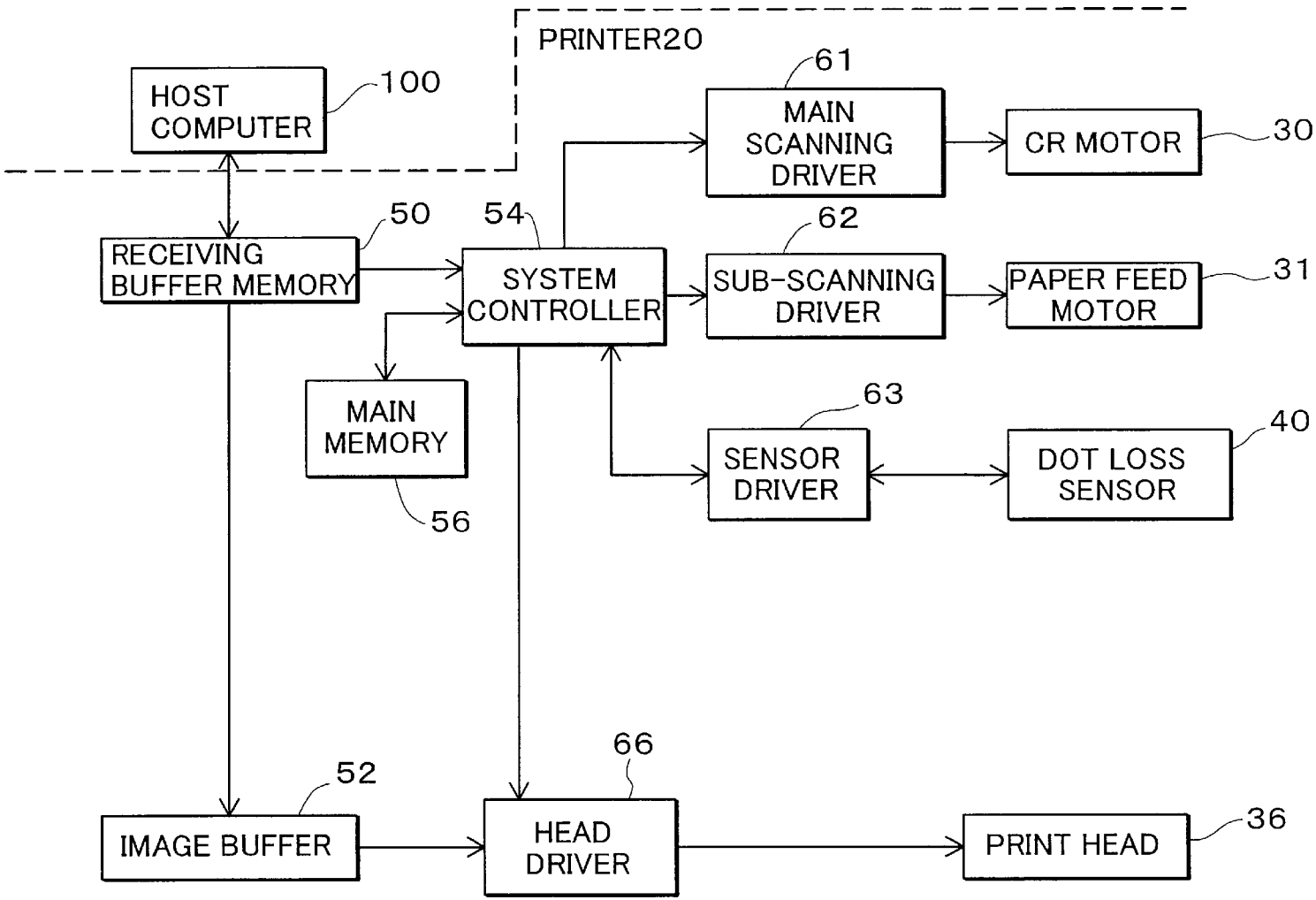
FIG. 2 is a block diagram depicting the electrical structure of the printer 20.

FIG. 2 is a block diagram depicting the electrical structure of the printer 20. The printer 20 comprises a receiving buffer memory 50 for receiving the signals presented by a host computer 100, an image buffer 52 for storing printing data, a system controller 54 for controlling the operation of the entire printer 20, and a main memory 56. The following drivers are connected to the system controller 54: a main scanning driver 61 for driving the carriage motor (step motor) 30, a sub-scanning driver 62 for driving a paper feed motor 31, a sensor driver 63 for driving the dot loss sensor 40, and the head driver 66 for driving the print head 36.

The printer driver (not shown) of the host computer 100 establishes various parametric values for defining the printing operation on the basis of the printing mode (high-speed printing mode, high-quality printing mode, or the like) specified by the user. On the basis of these parametric values, the printer driver generates print data for performing printing according to the specified printing mode and forwards these data to the printer 20. The data thus forwarded are temporarily stored in the receiving buffer memory 50. In the printer 20, the system controller 54 reads the necessary information from among the print data presented by the receiving buffer memory 50 and sends a control signal to each driver on the basis of this information.

The image buffer 52 stores print data for a plurality of color components. To obtain these data, the print data received by the receiving buffer memory 50 are decomposed for each color component. With the head driver 66, the print data for each color component from the image buffer 52 are read in accordance with the control signal from the system controller 54, and the nozzle array of each color provided to the print head 36 is driven in accordance with the result.

A-2. Structure of Dot Loss Sensor (1) Structure of Entire Dot Loss Sensor

Figure 3:
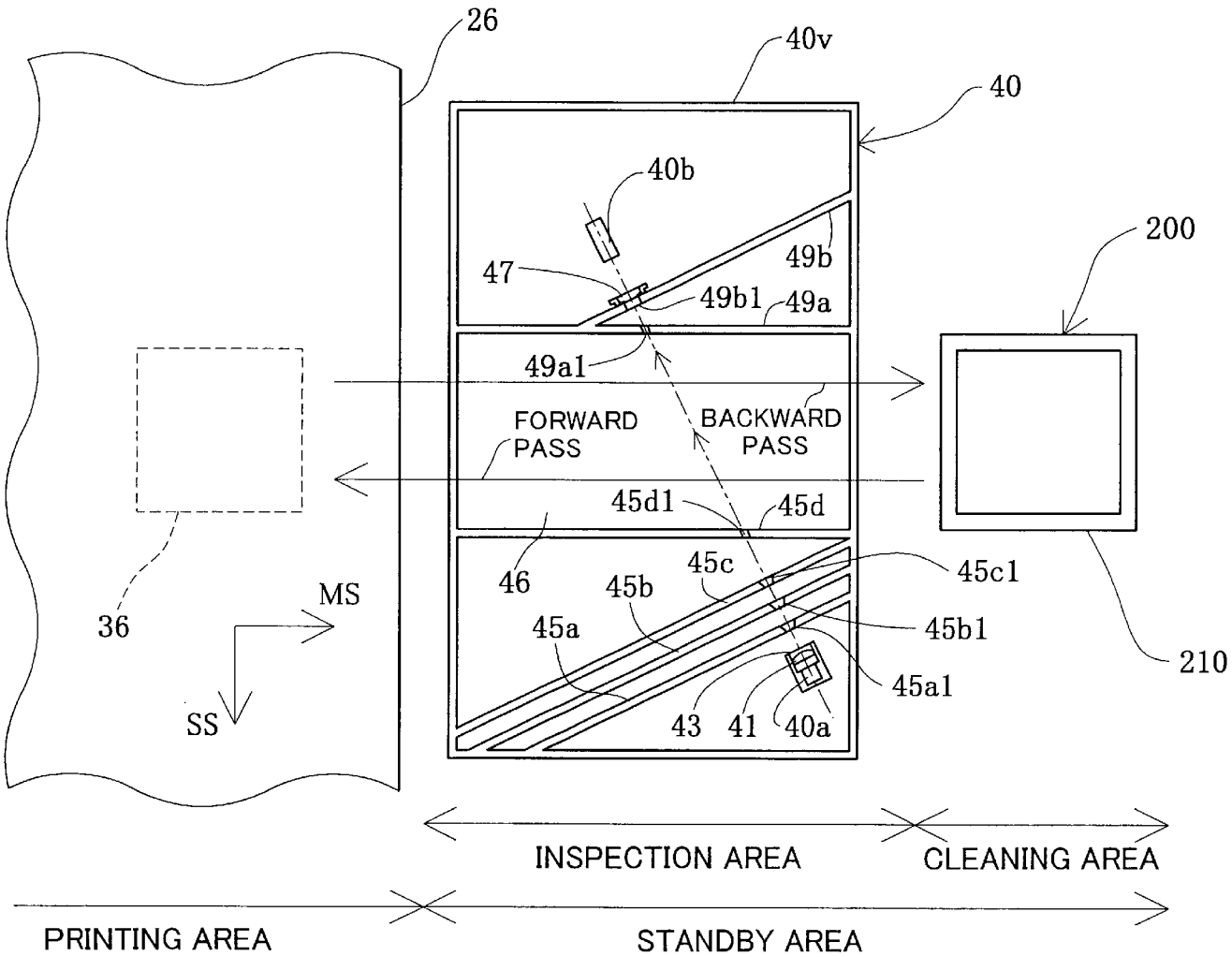
FIG. 3 is a diagram depicting the positional relation between a platen plate 26, dot loss sensor 40, waste ink reservoir 46, and head cap 210.
Figure 4:
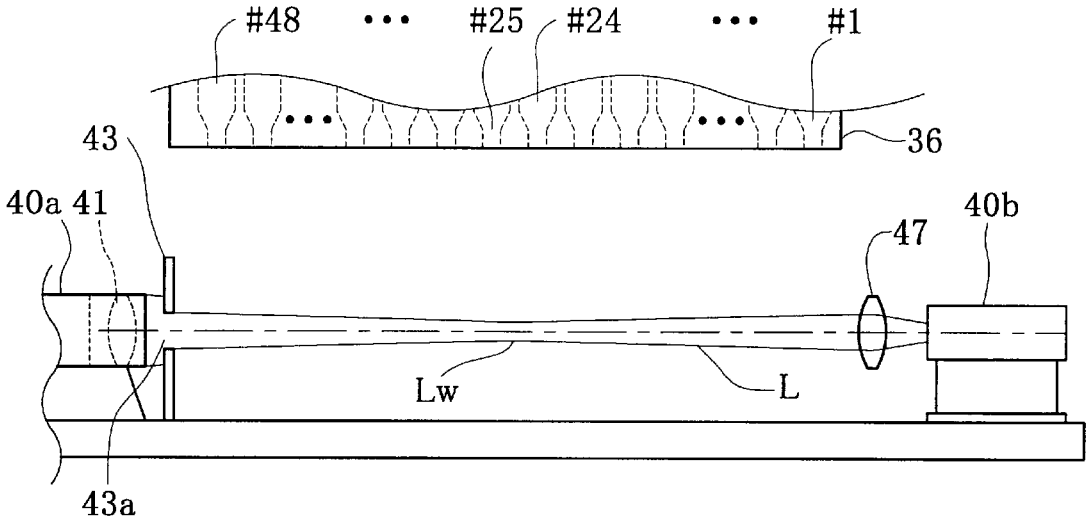
FIG. 4 is a side view depicting the principal structure of the dot loss sensor 40.

FIG. 3 is a plan view depicting the printer structure in the vicinity of the inspection area. FIG. 4 is a side view depicting the principal structure of the dot loss sensor 40.

As noted above, the dot loss sensor 40 comprises a light-emitting element 40*a* and light-receiving element 40*b*, with a waste ink reservoir 46 interposed therebetween. The light-emitting element 40*a* emits laser light at an angle of about 26 degrees to the sub-scanning direction, and the light-receiving element 40*b* receives this light. There are sequentially disposed a lens 41; an aperture plate 43; first ink mist screens 45*a*, 45*b*, 45*c*, and 45*d*; a waste ink reservoir 46; second ink mist screens 49*a* and 49*b*; and a lens 47 between the light-emitting element 40*a* and light-receiving element 40*b* in the direction of propagation of laser light emitted by the light-emitting element 40*a*, as shown in FIG. 3.

The lens 41 (first condensing element) is disposed downstream of the light-emitting element 40*a* in the direction of propagation of laser light. The lens 41 focuses the laser light emitted by the light-emitting element 40*a*.

The aperture plate 43 is disposed downstream of the lens 41 in the direction of propagation of laser light. The aperture plate 43 is provided with a focusing aperture 43*a* that is smaller than the area illuminated by laser light on the aperture plate 43, as shown in FIG. 4. Only the portion of the laser light near the optical axis passes through the focusing aperture 43*a*. As a result, laser light travels as a narrow beam with improved uniformity along the optical axis. The focusing aperture 43*a* has a round shape. The diameter of the focusing aperture 43*a* is selected such that the laser light L passing through the focusing aperture 43*a* provides a sufficient Signal-Noise (S/N) ratio for the light-receiving element 40*b* in detecting a non-operating nozzle. The sufficient value of S/N ratio can be appropriately selected in accordance with the size of ink droplets and/or the noise-producing mist-formation state of the inspection area. The aperture plate 43 corresponds to the "apertured element" referred to in the claims.

The first ink mist screens 45*a*, 45*b*, and 45*c* are disposed downstream of the aperture plate 43 in the direction of propagation of laser light, as shown in FIG. 3. The three first ink mist screens 45*a*, 45*b*, and 45*c* are configured as vertical walls in relation to the optical axis of laser light and are placed at regular intervals from each other. The first ink mist screens 45*a*, 45*b*, and 45*c* partition the space between the area in which ink droplets are ejected by the print head 36 over the waste ink reservoir 46, and the area including the light-emitting element 40*a*, lens 41, and aperture plate 43. The first ink mist screens 45*a*, 45*b*, and 45*c* are provided, respectively, with first apertures 45*a*1, 45*b*1, and 45*c*1 for the laser light. The laser light is directed through the first apertures 45*a*1, 45*b*1, and 45*c*1 toward the area above the waste ink reservoir 46.

The waste ink reservoir 46 is disposed between the first ink mist screen 45*d* and the second ink mist screen 49*a*, both of which are walls parallel to the main scanning direction MS. Similar to the first ink mist screens 45*a*, 45*b*, and 45*c*, the first ink mist screen 45*d*, which is located on the side of the waste ink reservoir 46 facing the light-emitting element 40*a*, partitions the space between the area in which ink droplets are ejected over the waste ink reservoir 46, and the area including the light-emitting element 40*a*, lens 41, and aperture plate 43. Similar to the other first ink mist screens, the first ink mist screen 45*d* is provided with a first aperture 45*d*1 for the laser light, which passes above the waste ink reservoir 46 through the first aperture 45*d*1. In the present embodiment, the elements for partitioning the space between the area in which ink droplets are ejected over the waste ink reservoir 46, and the area including the light-emitting element 40*a*, lens 41, and aperture plate 43 are referred to collectively as "first ink mist screens." The first ink mist screens 45*a*, 45*b*, 45*c*, and 45*d* are shown in FIG. 3 and are omitted from other drawings.

The dot loss sensor 40 is covered by a casing wall 40*v*, which extends along the external periphery thereof. The portion of the dot loss sensor 40 downstream of the first ink mist screen 45*d* in the direction of sub-scanning SS is covered with a top plate. The first ink mist screens 45*a*, 45*b*, 45*c*, and 45*d* cover the light-emitting element 40*a*, lens 41, and aperture plate 43 together with the top plate and the casing wall 40*v*, shielding them from the ink mist above the waste ink reservoir 46. The top plate is not shown in any of the drawings.

The bottom of the waste ink reservoir 46 is lined with felt for preventing the sputtering of ink droplets. Ink ejection is inspected in the area above the waste ink reservoir 46, and the ink droplets thus ejected are absorbed by the felt in the waste ink reservoir 46.

The second ink mist screen 49*a*, which is disposed on the side of the waste ink reservoir 46 facing the light-receiving element 40*b*, partitions the space between the area in which ink droplets are ejected over the waste ink reservoir 46, and the area including the lens 47 and light-receiving element 40*b*. The second ink mist screen 49*a* is provided with a second aperture 49*a*1 for the laser light traveling from the light-receiving element 40*b*, above the waste ink reservoir 46, and through the second aperture 49*a*1.

The second ink mist screen 49*b*, lens 47 (second condensing element), and light-receiving element 40*b* are disposed in the direction of propagation of laser light in the area on the side of the second ink mist screen 49*a* facing the light-receiving element 40*b*. The second ink mist screen 49*b* is a wall perpendicular to the optical axis of laser light. Similar to the second ink mist screen 49*a*, the second ink mist screen 49*b* partitions the space between the area in which ink droplets are ejected over the waste ink reservoir 46, and the area including the lens 47 and light-receiving element 40*b*. The second ink mist screen 49*b* is also provided with a second aperture 49*b*1 for the laser light. The laser light passes through the second aperture 49*b*1 and reaches the lens 47. In the present embodiment, the elements for partitioning the space between the area in which ink droplets are ejected over the waste ink reservoir 46, and the area including lens 47 and light-receiving element 40*b* are referred to collectively as "second ink mist screens." The second ink mist screens 49*a* and 49*b* are shown in FIG. 3 and are omitted from other drawings.

The portion of the dot loss sensor 40 upstream of the second ink mist screen 49*a* in the direction of sub-scanning SS is covered with the top plate. The second ink mist screens 49*a* and 49*b* cover the lens 47 and light-receiving element 40*b* together with the top plate and the casing wall 40*v*, shielding them from the ink mist above the waste ink reservoir 46. The top plate is not shown in any of the drawings.

The lens 47 has a light reception region of a prescribed surface area. The lens 47 is disposed downstream of the second ink mist screen 49*b* in the direction of propagation of laser light, receiving the laser light passing through the second aperture 49*b*1 of the second ink mist screen 49*b*, and focusing this light. The focused laser light is received by the light-receiving element 40*b*, which is disposed downstream of the lens 47. When ink ejection is inspected, the ejection of ink droplets can be confirmed based on the reduction in intensity of the laser light received by the light-receiving element 40*b*.

A-3. Dot Loss Inspecting Method (1) Relation Between Rows of Nozzles and Light-Emitting Element 40*a* and Light-Receiving Element 40*b*

Figure 5:
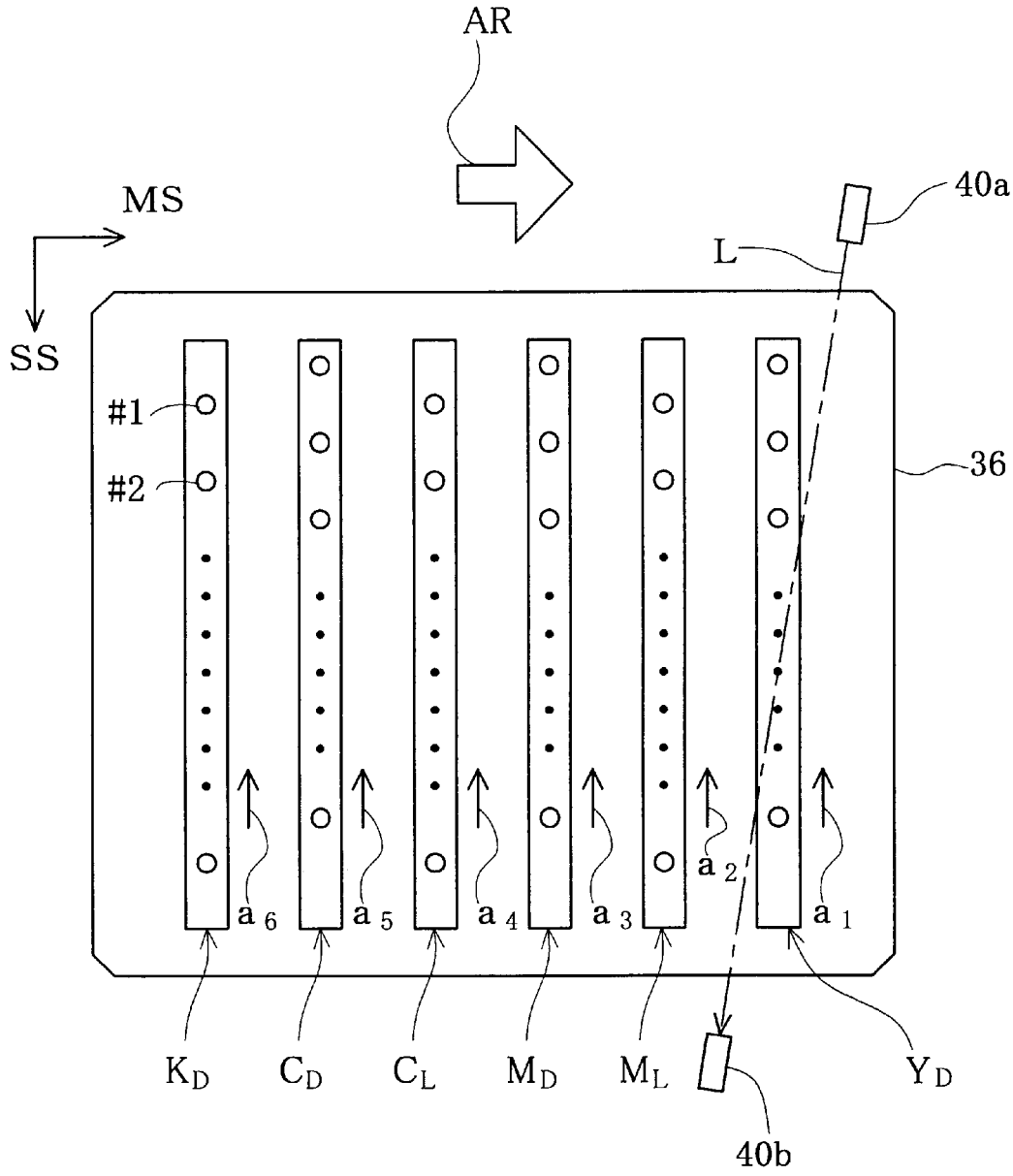
FIG. 5 is a diagram illustrating the structure of the first dot loss sensor 40 and the principle of the inspecting method.

FIG. 5 is a view of the print head 36 from below, including nozzle arrays for the six color components of the print head 36, and also shows the light-emitting element 40*a* and light-receiving element 40*b* constituting the first dot loss sensor 40.

The lower surface of the print head 36 is provided with a black ink nozzle row $K_D$ for ejecting black ink, a dark cyan ink nozzle row $C_D$ for ejecting dark cyan ink, a light cyan ink nozzle row $C_L$ for ejecting light cyan ink, a dark magenta ink nozzle row $M_D$ for ejecting dark magenta ink, a light magenta ink nozzle row $M_L$ for ejecting light magenta ink, and a yellow ink nozzle row $Y_D$ for ejecting yellow ink.

The first upper-case letter in the symbol designating each nozzle row refers to the ink color, the subscript "D" refers to an ink of comparatively high density, and the subscript "L" refers to an ink of comparatively low density. The subscript "D" in the term "yellow ink nozzle row $Y_D$" means that the yellow ink will make a gray color when mixed with the dark cyan ink and dark magenta ink in substantially equal proportions. The subscript "D" in the term "black ink nozzle row $K_D$" means that the black ink has a 100%-dense black color without any grayness.

The nozzles constituting each nozzle row are arranged in the sub-scanning direction SS. During printing, ink droplets are ejected from the nozzles while the print head 36 moves together with the carriage 28 (FIG. 1) in the main scanning direction MS.

The light-emitting element 40*a* is a laser for emitting a light beam L whose outside diameter is about 1 mm or less at the point of emission. Laser light L is emitted in a direction inclined at about 26 degrees to the sub-scanning direction SS, and is received by the light-receiving element 40*b*, as shown in FIG. 5. In other words, laser light L is emitted in a direction inclined at about 26 degrees to the rows of nozzles aligned with the sub-scanning direction SS.

(2) Principle of Dot Loss Inspection

Figure 6:
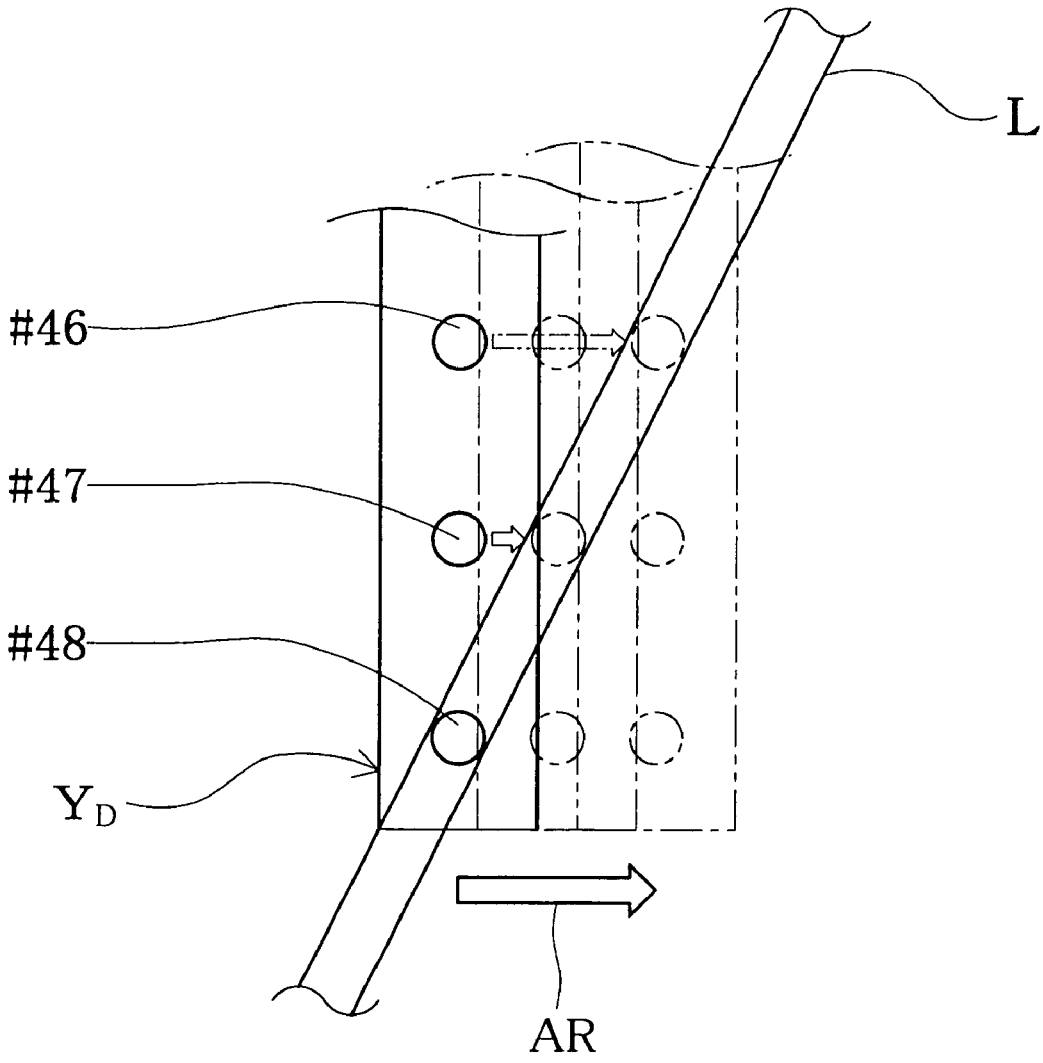
FIG. 6 is an enlarged view illustrating the principle of the inspecting method for dot loss inspection.

FIG. 6 is an enlarged view illustrating the principle of the dot loss inspection. During such dot loss inspection, the print head 36 is moving at a constant speed, as shown by arrow AR in FIG. 5, and the nozzle groups gradually approach the laser light L, starting from the dark yellow ink nozzle group $Y_D$. In the process, as the print head 36 advances, laser light L travels (in relative terms) through the space below nozzle No. 48, No. 47, No. 46, . . . , starting from the bottom end of the dark yellow ink nozzle group $Y_D$, as shown in FIG. 6. It is assumed herein that the group of nozzles for each color component of the print head 36 has 48 nozzles (Nos. 1 to 48).

After crossing the path of nozzle No. 1, which is located at the top end of the dark yellow ink nozzle group $Y_D$, laser light L traverses the space below nozzle No. 48, No. 47, No. 46, . . . , of the light magenta ink nozzle row $M_L$. The space below each nozzle is traversed (in relative terms) in the same manner all the way to nozzle No. 1 at the top end of the black ink nozzle row $K_D$, as shown by the arrows $a_1$, $a_2$, $a_3$, and the like in FIG. 5.

Instructions are provided for each nozzle to eject ink droplets for a prescribed period so that the ink droplets cross the path of laser light L. Specifically, a plurality of ink droplets are ejected for a given time such that the ink droplets travel through a common space formed by the ink droplet trajectory and the ink droplet sensing space of laser light L when the two loci intersect each other. This arrangement makes it easier to confirm blockage of laser light L.

As used herein, the "ink droplet sensing space" of laser light L refers to a space on the optical path of laser light L where light intensity per unit surface area is sufficient to detect an ink droplet. For the sake of convenience, "the ink droplet sensing space of laser light L" will occasionally be abbreviated herein as "laser light L." This will be merely indicated as "L" in the drawings. Although the light used in the first embodiment is laser light, using light other than laser light will still allow the "ink droplet sensing space" to be defined as a space on the optical path of light emitted by the light-emitting element where light intensity per unit of surface area is greater than a prescribed value.

The term "ink droplet trajectory" refers to a trajectory described by ink droplets of prescribed size that are ejected from nozzles and move through space. If the ink droplets are ejected from the nozzles normally within the predicted range in a state in which the ink droplet trajectory and the ink droplet sensing space of laser light L form a common subspace, the ink droplets thus ejected will traverse the ink droplet sensing space of laser light L.

When ink droplets are normally ejected downward from the nozzles, the ink droplets thus ejected travel through the ink droplet sensing space of laser light L during part of their journey, temporarily blocking or attenuating the light received by the light-receiving element 40*b* and bringing the luminous energy thus received below a prescribed threshold value. It can be concluded in this case that the nozzle remains unclogged. If, however, the luminous energy received by the light-receiving element 40*b* exceeds the prescribed threshold value during the drive period of a nozzle, it is concluded that the nozzle may be clogged.

Consequently, the "ink droplet sensing space" of laser light L refers to a space on the optical path of laser light L where light intensity per unit surface area is sufficient for the light-receiving element 40*b* to detect a reduction in luminous energy when an ink droplet being sensed travels through this space and blocks light in an amount proportional to the surface area of the droplet protrusion.

The inspection is performed for all the nozzles in the above-described manner up to nozzle No. 1 at the top end of black ink nozzle row $K_D$.

The inspection may be performed in any main scanning direction, which is related to the direction in which the print head 36 is advanced. The arrangement adopted herein is described with reference to a case in which a print head 36 on a carriage 28 (FIG. 1) is pulled by a traction belt 32 driven by a step motor 30, and is advanced along guide rails 34 in the main scanning direction. It is also possible, however, to use a head scanning and driving device designed specifically for inspecting purposes. In other words, the printer may be provided with an advancement mechanism in which the relative positions of the nozzles and the sensor are varied by moving the nozzles and/or the sensor. The device can be miniaturized by forming a single mechanism that combines in itself the device for moving the nozzles along the main scanning direction during printing and the device for performing scanning during inspection. Providing a separate device for performing scanning during inspection yields an apparatus that has high positional accuracy and is ideally suited for inspection.

(3) Nozzle Grouping and Ejecting Inspection of Each Test Group

In the first embodiment, the nozzles provided to the print head 36 are divided into six test groups. Each test group is separately inspected for ejection.

Figure 7:
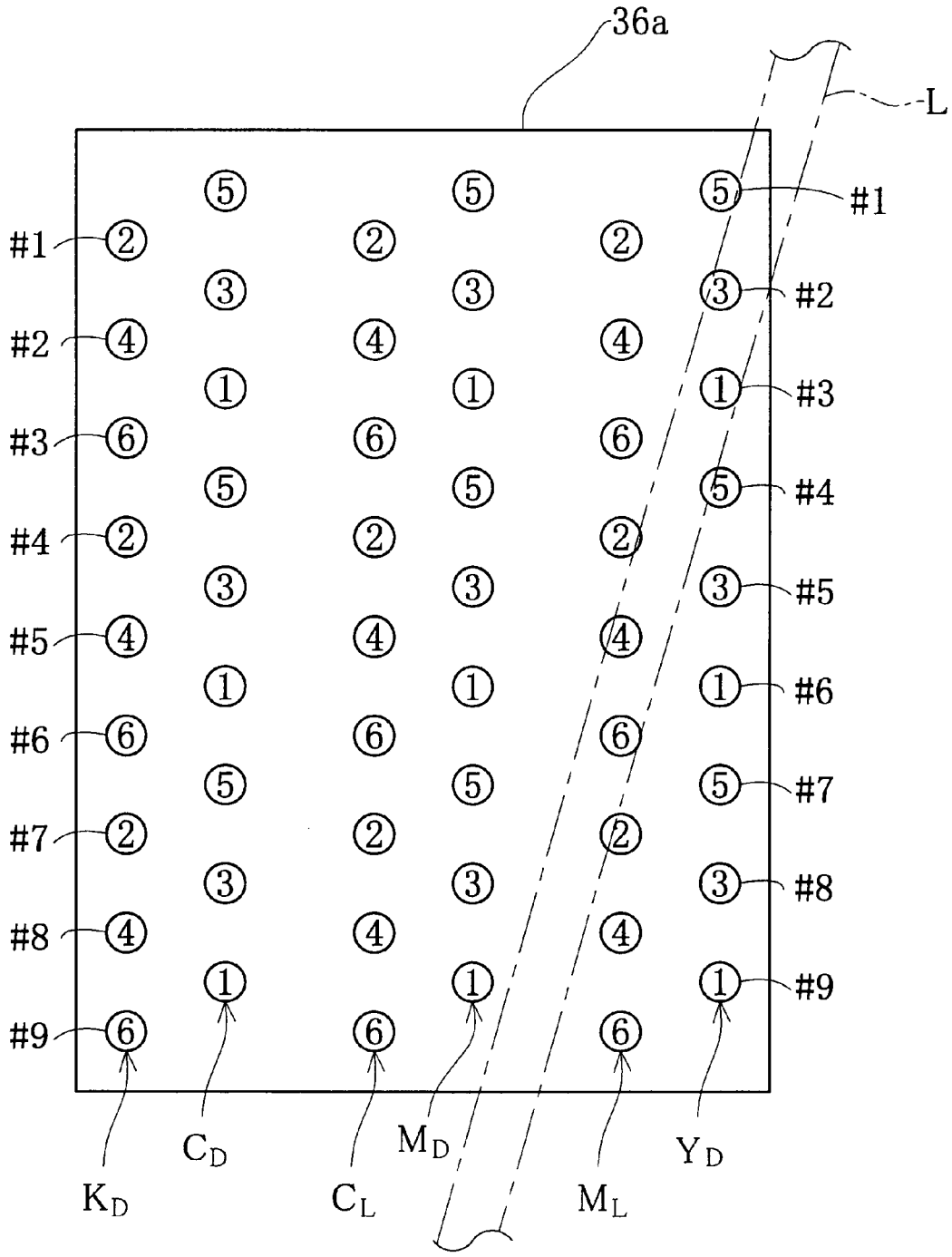
FIG. 7 is a diagram illustrating a state in which the nozzles of a print head 36*a* are divided into groups.

FIG. 7 illustrates the nozzle grouping. For the sake of convenience, the print head 36 is simplified to a print head 36*a* having six rows of nozzles, with each row composed of nine nozzles. In FIG. 7, each nozzle has a circled number (1–6) designating the test group to which the nozzle belongs. The print head 36*a* is the same as the print head 36 except the number of nozzles. When the print head 36*a* crosses the path of laser light L during an initial pass of inspection, nozzle No. 9 of the nozzle row $Y_D$ is the first to move across the laser light L, and nozzle No. 1 of the nozzle row $K_D$ is the last to move across the laser light L. FIG. 7 is merely designed to illustrate the nozzle grouping, and the nozzle pitch or the interval between nozzle rows does not reflect the actual dimensions.

The 9×6 nozzles are divided into six groups, each containing nine nozzles. Specifically, the first test group contains nozzle Nos. 9, 6, and 3 of nozzle rows $Y_D$, $M_D$, and $C_D$; the third test group contains nozzle Nos. 8, 5, and 2 of nozzle rows $Y_D$, $M_D$, and $C_D$; and the fifth test group contains nozzle Nos. 7, 4, and 1 of nozzle rows $Y_D$, $M_D$, and $C_D$. The above test groups contain all the nozzles of nozzle rows $Y_D$, $M_D$, and $C_D$. The second test group contains nozzle Nos. 1, 4, and 7 of nozzle rows $K_D$, $C_L$, and $M_L$; the fourth test group contains nozzle Nos. 2, 5, and 8 of nozzle rows $K_D$, $C_L$, and $M_L$; and the sixth test group contains nozzle Nos. 3, 6, and 9 of nozzle rows $K_D$, $C_L$, and $M_L$. The above test groups contain all the nozzles of rows $K_D$, $C_L$, and $M_L$.

The print head 36 having 48 nozzles per row and pertaining to the first embodiment is also configured such that each test group is composed of every third nozzle selected from alternate rows of nozzles ($Y_D$, $M_D$, and $C_D$; $K_D$, $C_L$, and $M_L$) in the manner described above. The manner in which ink droplets are ejected is inspected for each test group on the forward and backward passes of main scanning.

The relation between the forward/backward pass of main scanning and the manner in which the ejection of ink droplets is inspected for each test group will now be described with reference to FIG. 3. Laser light is emitted by the light-emitting element 40*a* in the direction of the light-receiving element 40*b* across the area above the waste ink reservoir 46. When the print head 36 is transported (backward pass) across the area above the waste ink reservoir 46 following a printing operation based on the initial main scanning of the printing area, nozzles belonging to a first test group are instructed to eject ink droplets across this laser light. The manner in which the ink droplets are ejected is evaluated based on the blockage of laser light by the ink droplets. Specifically, nozzles belonging to the first test group are inspected to determine how well they eject ink droplets. The print head 36 is then allowed to pass over the waste ink reservoir 46, turned in a different direction, and is transported in the direction of the printing area (forward pass). When the print head 36 again passes over the waste ink reservoir 46, nozzles belonging to a second test group are now instructed to eject ink droplets across the laser light, and the manner in which the ink droplets are ejected is inspected. The print head 36 is then transported to the printing area, and images are printed in this area. Specifically, the following operations are performed when the print head 36 is caused to make a round trip in the main scanning direction over a path that extends across the printing area and standby area after printing has been started: printing during the backward pass, inspection of ink ejection for the first test group during the backward pass, inspection of ink ejection for the second test group during the forward pass, and printing during the forward pass.

When the print head 36 is subsequently transported for a second time to the standby area after images have been printed in the printing area, ink ejection is inspected for the third test group during the backward pass, and the manner in which ink droplets are ejected by the fourth test group is inspected during the forward pass. Ejection is then inspected for the fifth and sixth test groups when printing is subsequently completed in the printing area and the print head 36 is transported to the standby area. Printing is then completed in the printing area, ejecting inspection is performed again for the first and second test groups, and this ejecting inspection is sequentially repeated for each test group.

Specifically, each test group is inspected to determine how well it ejects ink droplets every time the print head 36 makes a single backward or forward pass in the main scanning direction. A single round trip of the print head 36 in the main scanning direction allows two test groups to be inspected for ejection, and three round trips allow all the nozzles on the print head 36 to be inspected for ejection. These operations are performed using the system controller 54 (FIG. 2) to control the carriage motor 30, dot loss sensor 40, and print head 36 via drivers.

Figure 8:
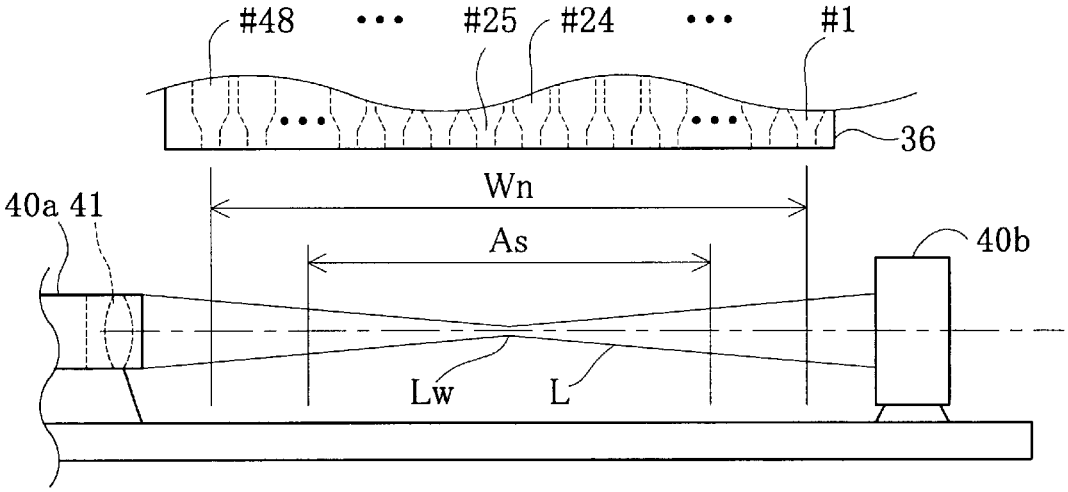
FIG. 8 is a diagram illustrating the manner in which the beam diameter of laser light varies when focused solely by a lens.
Figure 9:
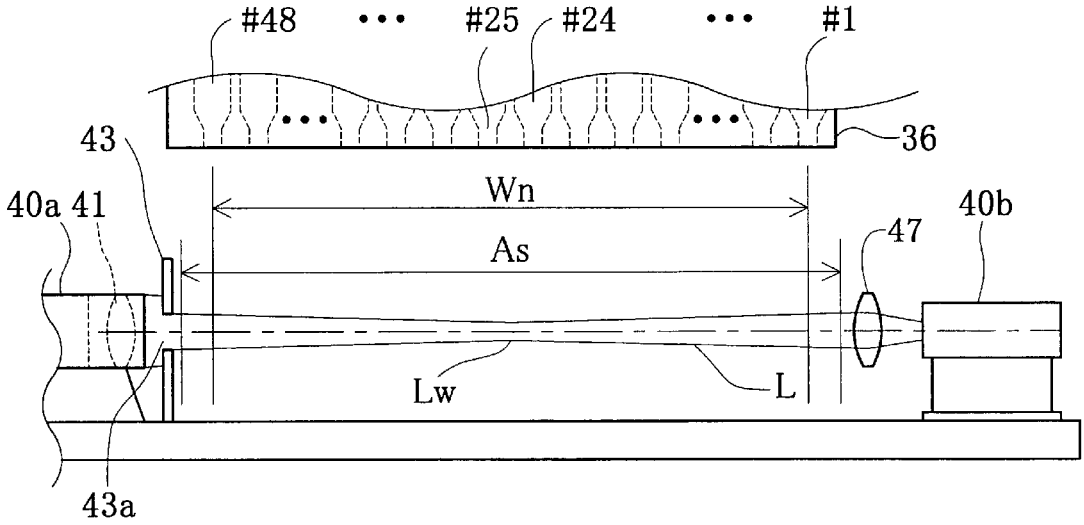
FIG. 9 is a diagram illustrating the manner in which the beam diameter of laser light varies in the first embodiment.

A-4. Merits of First Embodiment (1) Reduced Variations in Inspecting Conditions for Each Nozzle, and Increased Inspecting Range FIG. 8 is a diagram illustrating the manner in which the beam diameter of laser light L varies when focused solely by a lens. FIG. 9 is a diagram illustrating the manner in which the beam diameter of laser light varies in the first embodiment. In the first embodiment, laser light is focused by the lens and the focusing aperture 43*a* provided to the aperture plate 43 in the manner shown in FIG. 9. Laser light narrows after passing through the focusing aperture 43*a*. To simultaneously achieve a reduction in the focusing angle, the beam diameter at the beam waist Lw is increased in comparison with the case in which laser light L is focused solely by the lens 41 (see FIG. 8). As a result, variations in the beam thickness of laser light L along the optical path are reduced in comparison with the case in which laser light is focused by the lens 41 alone, and the laser light becomes more uniform along the optical path. The difference in inspecting conditions between a nozzle inspected in the vicinity of beam waist Lw and a nozzle inspected at a distance from the beam waist Lw is less than when the light is focused solely by a lens. The ink ejection can therefore be inspected with less variations in detection accuracy among nozzles when the output of the light-emitting element 40*a* and the detection gain of the light-receiving element 40*b* are well adjusted.

In the modification of the first embodiment shown in FIG. 9, the range As for detecting ink droplets can be widened as long as the variations in the detection accuracy of each nozzle are kept substantially the same as those achieved when light is focused by the lens 41 alone. The manner in which ink droplets are ejected can therefore be inspected with a single beam of laser light even for longer nozzle rows. In FIGS. 8 and 9, Wn is the range within which nozzles are provided. In the modification of the first embodiment shown in FIG. 9, a detectable range As within which ink droplets can be detected is wider than the range Wn within which nozzles are provided.

Furthermore the beam waist position is moved closer to the light-emitting element 40*a* by the diffraction at the focusing aperture 43*a*. It is therefore possible to move the detectable range As for detecting ink droplets closer to the light-emitting element 40*a* and to reduce the distance between the light-emitting element 40*a* and the light-receiving element 40*b*. In other words, the device can be designed as a smaller structure.

The light beam focused by the lens can detect ink droplets in the detectable range As as long as the inspecting conditions fall within a prescribed range. The detectable range As has the beam waist as its center. A reason why such a range As exists is as follows. Specifically, a light beam has a certain intensity distribution, with the maximum on the optical axis, when viewed within a cross section perpendicular to the optical axis. An arbitrary cross section perpendicular to the light beam includes a circular range within which the light intensity is grater than a predetermined value p. The diameter of the circular range, or ink droplet sensing space increases as the cross section moves closer to the beam waist Lw. Conversely, the diameter of the ink droplet sensing space is too small if the cross section is far from the beam waist Lw and the light beam cannot detect ink droplets. Consequently, a light beam focused by a lens contains the detectable range As that allows ink droplets to be detected as long as the inspecting conditions fall within a prescribed range. In the first embodiment, the intensity distribution of light on a cross section perpendicular to the optical axis shows less variation along the optical path than in the comparative example of FIG. 8 because of the use of the focusing aperture 43*a*. This reduces variations in the diameter of the ink droplet sensing space along the optical path and increases the size of the detectable range As.

Figure 10:
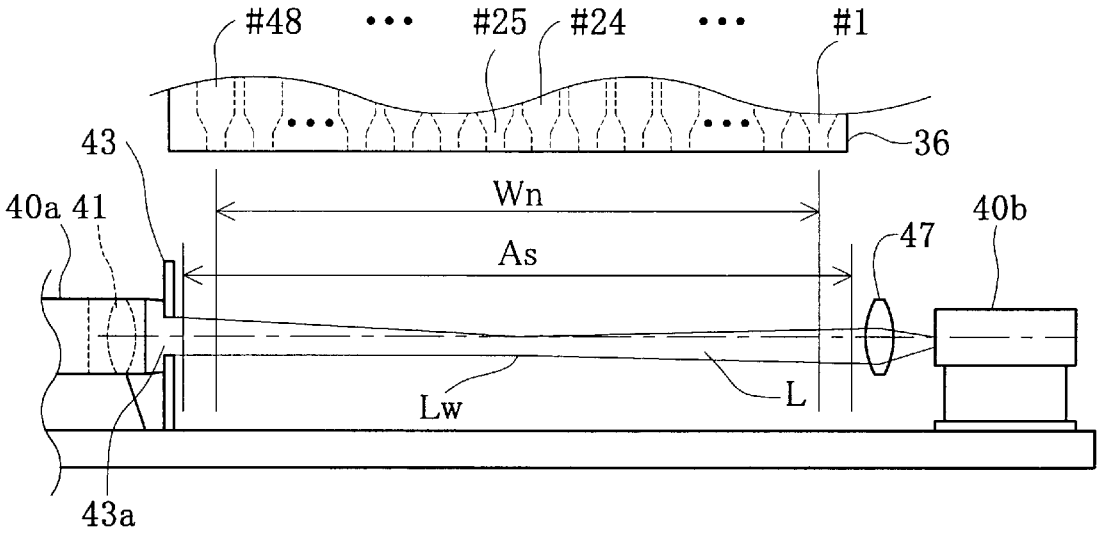
FIG. 10 is a diagram illustrating a case in which the optical path of laser light has deviated from the initially intended emission direction.

(2) Increasing Tolerance Limit for Laser Light Deviation From Emission Direction FIG. 10 is a diagram illustrating a case in which the optical path of laser light has deviated from designed one. In the first embodiment, laser light, rather than being received by the light-receiving element 40*b* directly, is received by the light-receiving element 40*b* via a lens 47 whose light reception region has a prescribed surface area. The result is that even when laser light diverges from the correct direction due to misalignment, the laser light can still be focused by the lens 47, refracted, and received by the light-receiving element 40*b* as long as the illumination position falls within the light reception range of the lens 47. Consequently, the inspecting function can be preserved even when laser light diverges somewhat from the correct direction.

(3) Reduced Degradation of Inspecting Performance Due to Ink Mist

In the first embodiment, first ink mist screens 45*a*, 45*b*, 45*c*, and 45*d* are disposed between the region in which the print head 36 moves in the main scanning direction and the space including the light-emitting element 40*a*, lens 41, and aperture plate 43. The space including the light-emitting element 40*a*, lens 41, and aperture plate 43 is covered by the casing wall 40*v* everywhere except on the side where the first ink mist screens are installed, and the top portion thereof is covered with a top plate. This arrangement effectively prevents the ink mist produced by the ejection of ink droplets from being deposition the light-emitting element 40*a*, lens 41, or aperture plate 43. Similarly, second ink mist screens 49*a* and 49*b* are disposed between the region in which the print head 36 moves in the main scanning direction and the space including the lens 47. The space including the light-receiving element 40*b* and lens 41 is defined by the casing wall 40*v* and the top plate. This arrangement prevents the ink mist produced by the ejection of ink droplets from being deposition on the lens 47 or light-receiving element 40*b*. Since a plurality of shields are provided, straightly propagating light is allowed to pass through the apertures while the ink mist carried by the gas flow is prevented from passing. It is therefore unlikely that the optical mechanism will be adversely affected by the ink mist in terms of performance, thus allowing ink ejection to be inspected for a long time with consistent accuracy.

(4) Preventing Confusion Between Ink Droplets Ejected By Different Nozzles

Figure 11:
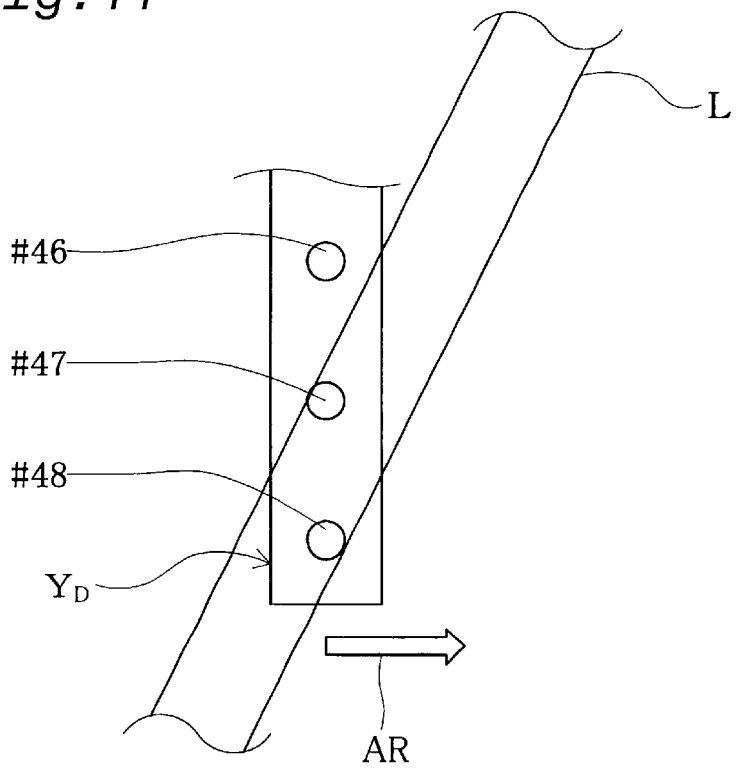
FIG. 11 is a diagram illustrating the relation between the nozzles and the ink droplet sensing space of laser light L.

FIG. 11 is a diagram illustrating the relation between the nozzles and the ink droplet sensing space of laser light L. In the first embodiment shown in FIG. 7, each test group is composed of every third nozzle of alternate rows of nozzles, and ink ejection is inspected for each test group during the forward and backward pass of main scanning. Compared with a case in which all the nozzles of a print head are inspected, the distance between the two closest nozzles in a test group is increased threefold in the row direction and twofold between the rows. Adopting this arrangement prevents situations in which the ink droplet trajectories of two or more test nozzles intersect the ink droplet sensing space at the same time (as shown in FIG. 11), and makes it less likely that ink droplets ejected by different nozzles will be confused when the ejection of ink droplets is inspected. This reduces the possibility that a test nozzle will be identified as operating normally as a result of the fact that ink droplets ejected by other nozzles have been detected.

Following is a more detailed description of an example in which the aforementioned effects are obtained using the print head 36*a*. In this example, nozzle No. 3 in nozzle row $Y_D$ is inspected, as shown in FIG. 7. Consequently, an intersecting state is established in FIG. 7 between the ink droplet sensing space L of laser light and the ink droplet trajectory of nozzle No. 3 in nozzle row $Y_D$ belonging to the first test group. No intersection with the sensing space L is established for the ink trajectory of nozzle No. 6 in nozzle row $Y_D$, which is a nozzle that belongs to the same first test group and forms an intersection with the sensing space L one step prior to nozzle No. 3. Nor is there any intersection of the sensing space L with the ink trajectory of nozzle No. 9 in nozzle row $M_D$, which is a nozzle that forms an intersection with the sensing space L subsequent to nozzle No. 3. It is therefore possible to avoid confusion when ink droplets ejected from nozzle Nos. 6 and 3 in nozzle row $Y_D$ and nozzle No. 9 in nozzle row $M_D$ are successively inspected as part of the first test group. In FIG. 7, the nozzles inside the laser light L shown by the dashed line lie on an intersection between the ink droplet trajectory and the ink droplet sensing space of laser light.

When projected on a plane parallel to the nozzle rows, the detective range As (see FIG. 9) has a projected length which decreases with an increase in the incline of laser light relative to the direction parallel to the nozzle rows (sub-scanning direction in the first embodiment). Consequently, increasing the incline in relation to the direction parallel to the nozzle rows makes it difficult to fit all the nozzles of a nozzle row within the detectable range As even if laser light allows all the nozzles of the nozzle row to fit within the detectable range As when the laser light is inclined only slightly in relation to the direction parallel to the nozzle rows. Accordingly, the incline of laser light in relation to the direction parallel to nozzle rows is preferably kept sufficiently small to allow all the nozzles of a nozzle row to fit within the detectable range As. However, further reducing the incline of laser light in relation to the direction parallel to nozzle rows increases the likelihood that the ink droplet sensing space of the laser light will intersect the ink droplet trajectories of a plurality of nozzles at the same time and will create confusion during the inspection of ink ejection, as shown in FIG. 11. Consequently, adopting a method in which the incline of laser light is reduced but the ejection of ink droplets is inspected separately for each test group in accordance with the first embodiment is highly effective for allowing all the nozzles of a nozzle row to fit within the detectable range As while preventing ink droplets from being mistaken for one another when their ejection is inspected. It should be noted, however, that reduction of the incline of laser light increases the number of test groups in order to prevent confusion between the ink droplets of each nozzle, increasing the time interval between the acts of inspecting each nozzle. For this reason, the incline of laser light in relation to the direction parallel to nozzle rows is in a range from 20 to 35 degrees, and preferably from 23 to 30 degrees.

A-5. Modification of First Embodiment

Although laser light is used in the first embodiment as the light for inspecting ink ejection, other types of light can be used for the ejecting inspection, such as focused light emitted by a light-emitting diode.

The means for partitioning the space between the area for ejecting ink droplets and the area including the light-emitting element 40*a*, lens 41, and aperture plate 43 is not necessarily limited to the top plate and the flat wall placed around the light-emitting element 40*a*, lens 41, and aperture plate 43 in accordance with the present embodiment. It is, for example, possible to use a dome-shaped wall for covering the entire periphery of the light-emitting element 40*a*, lens 41, and aperture plate 43. The means for partitioning the space between the area for ejecting ink droplets and the area including the light-emitting element 40*a*, lens 41, and aperture plate 43 may be other than a thin wall. Specifically, a structure of any thickness or shape can be used as long as this structure is disposed at an exit side of the provided in the direction of propagation of light that passes through the focusing aperture 43*a* of the aperture plate 43, is configured as a member for separating the area in which nozzles eject ink droplets in the direction of an optical path from the area including the lens 41 and aperture plate 43, and is provided with a first aperture for the detection light, disposed at an exit side of the first condensing element and the apertured element and disposed in the direction of propagation of laser light. The same applies to the means for partitioning the region designed for ejecting ink droplets and the space including the lens 47 and light-receiving element 40*b*.

Figure 12:
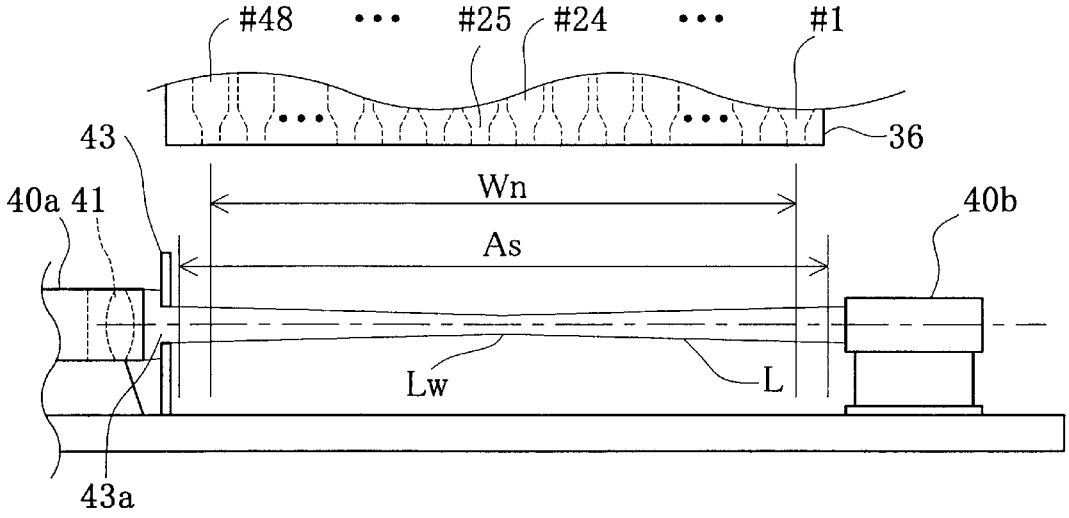
FIG. 12 is a diagram illustrating a dot loss sensor devoid of the lens 47 on the light-receiving side.

FIG. 12 is a diagram illustrating a modified sensor according to the first embodiment. In this modified embodiment, the lens 47 on the light receiving side is dispensed with. The rest of the structure is the same as in the first embodiment. This structure is similar to the structure in the first embodiment in that because laser light is focused by the focusing aperture 43*a*, variations in the diameter of the ink droplet sensing space is controlled and differences in the inspecting conditions is reduced in comparison with a case in which laser light is focused solely by a lens.

The nozzles constituting the test groups are not limited to every third nozzle of alternate nozzle rows. Specifically, each test group may comprise nozzles selected in a systematic manner at a rate of one out of every n nozzles (where n is an integer of 2 or greater) in each nozzle row, or nozzles in the rows selected in a systematic manner at a rate of one out of every m rows (where m is an integer of 2 or greater). The n and m values are set to appropriate integers in accordance with the nozzle pitch, the interval between nozzle rows, the shape of the ink droplet sensing space and the direction of the optical axis, and each act of ejecting inspection is limited to the nozzles belonging to a single test group, making it possible to prevent the ink droplet sensing space of laser light L from interfering with the paths of ink droplets ejected by a plurality of nozzles. If the nozzle pitch and the interval between nozzle rows are sufficiently large and the ink droplet sensing space of laser light is prevented from simultaneously intersecting with the ink droplet trajectories of a plurality of nozzles, it is possible to dispense with the arrangement in which the nozzles on the print head are divided into groups and each group is inspected to determine how well it ejects ink droplets.

B. Second Embodiment

B-1. Device Structure

Figure 13:
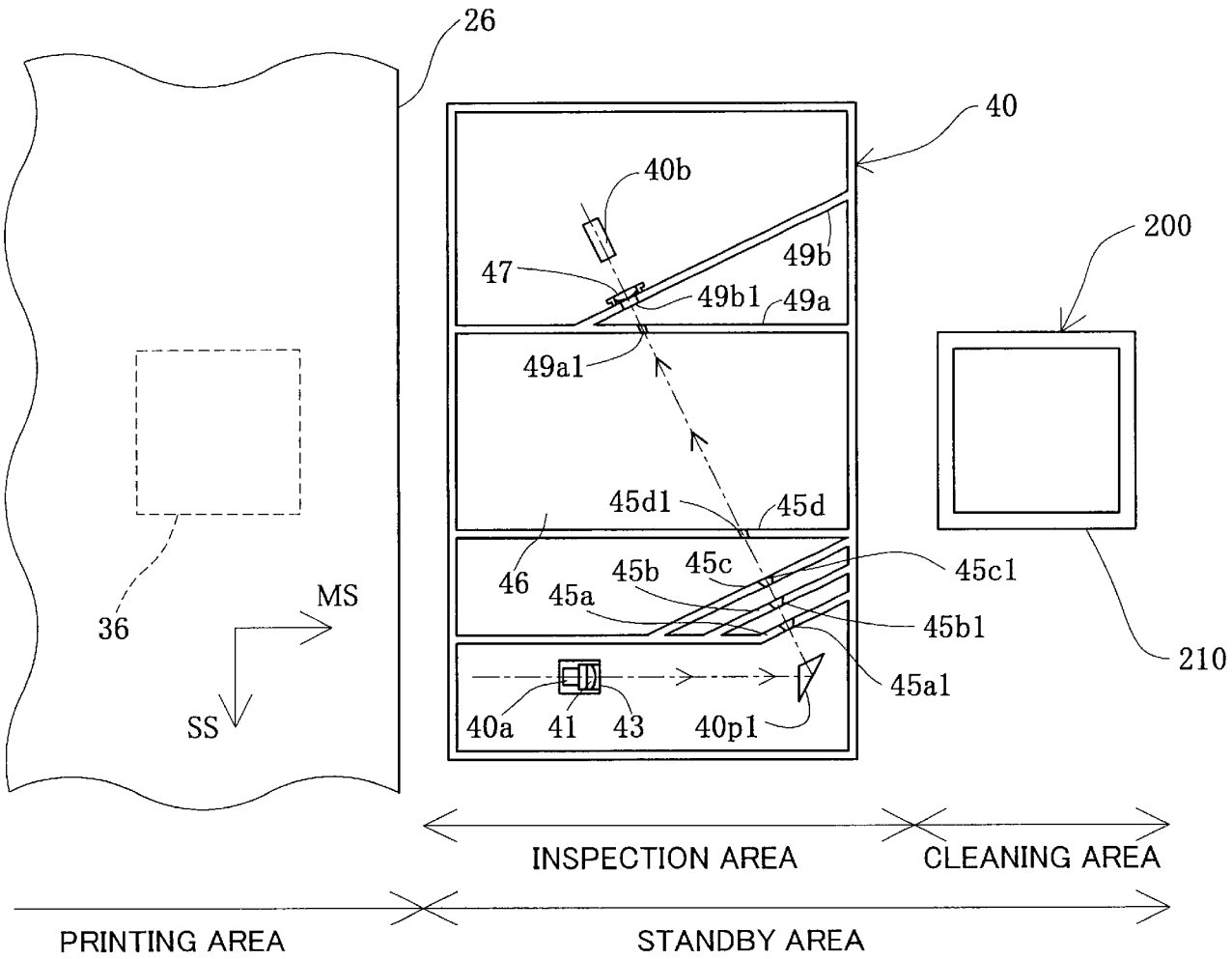
FIG. 13 is a diagram illustrating the dot loss sensor according to a second embodiment.

FIG. 13 is a diagram illustrating the dot loss sensor according to a second embodiment. In the second embodiment, a prism 40*p*1 is provided at the position occupied by the light-emitting element 40*a*, lens 41, and aperture plate 43 in the first embodiment. The light-emitting element 40*a*, lens 41, and aperture plate 43 are disposed at a prescribed position on the side of the prism 40*p*1 facing the platen plate 26 in the main scanning direction. The rest of the structure is the same as in the first embodiment. In the second embodiment, laser light is emitted by the light-emitting element 40*a*, transmitted by the lens 41 and the focusing aperture 43*a* of the aperture plate 43, reflected by the prism 40*p*1, and received by the light-receiving element 40*b*. The process whereby laser light is transmitted to the light-receiving element 40*b* after being reflected by the prism 40*p*1 is the same as in the first embodiment.

B-2. Merits of Second Embodiment

To achieve smaller variations in the intensity distribution of light along an optical path of laser light focused by a lens, a longer optical path is better between the light-emitting element 40*a* and the inspecting section. This is because variations in the intensity distribution per unit of length along the optical path can be reduced by increasing the distance between the light-emitting element 40*a* and the beam waist. In the second embodiment, the length of the optical path up to the inspecting section thereof is increased in comparison with the first embodiment by reflecting laser light at the prism 40*p*1. Variations in the intensity distribution of light is thereby reduced in comparison with the first embodiment. At the same time, any increase in the size of the device due to the lengthening of the optical path is prevented by using the prism 40*p*1. The prism 40*p*1 can be replaced with any device capable of reflecting laser light, such as a mirror obtained by vapor-depositing aluminum on a transparent substrate.

B-3. Modification of Second Embodiment

Figure 14:
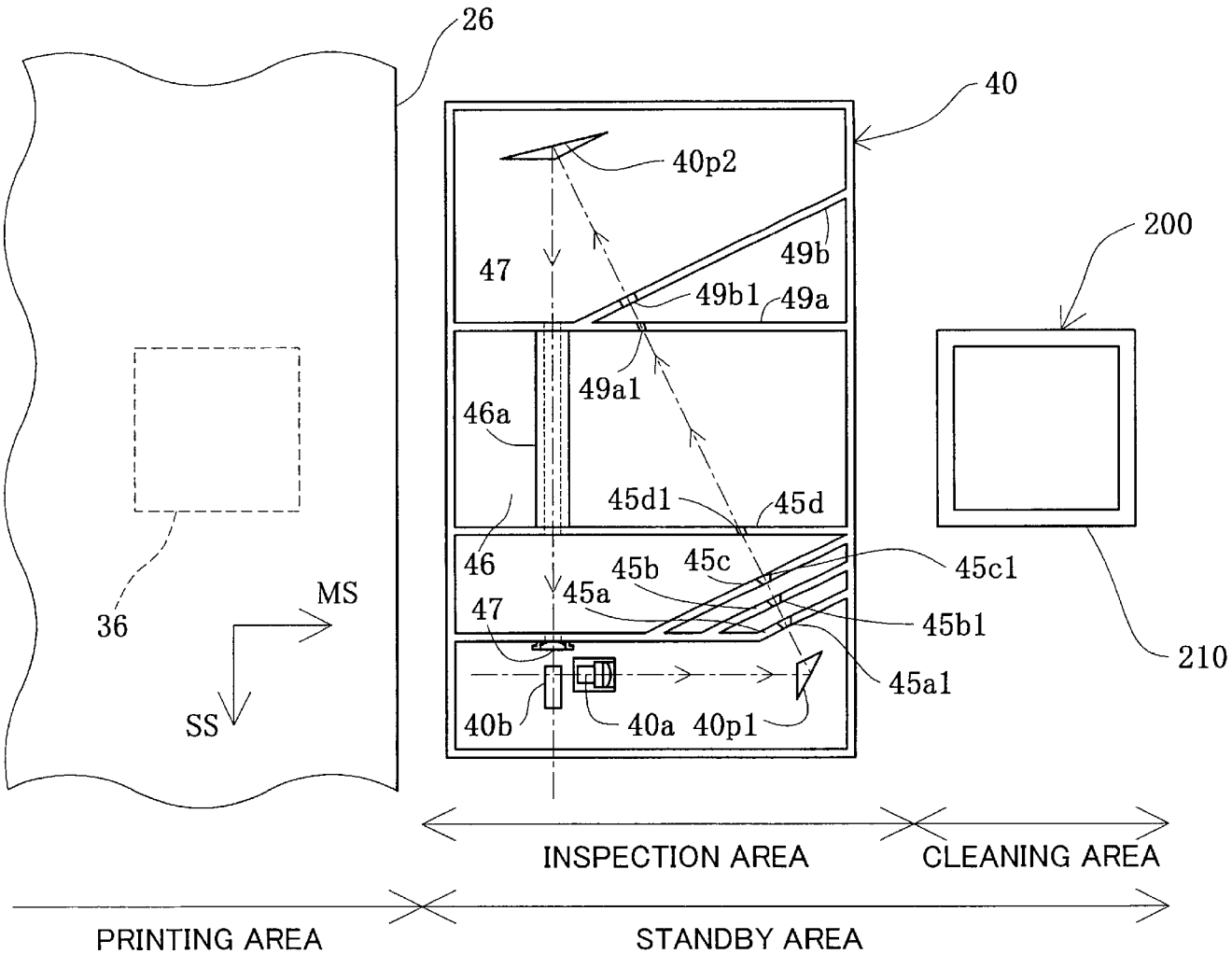
FIG. 14 is a diagram illustrating the dot loss sensor according to a modification of the second embodiment.

FIG. 14 is a diagram illustrating the dot loss sensor according to a modification of the second embodiment. In the modified embodiment, the light-emitting element 40*a*, lens 41, aperture plate 43, and prism 40*p*1 are disposed in the same manner as in the second embodiment but the light-receiving element 40*b* and lens 47 are disposed adjacent to the light-emitting element 40*a* on the same side as the light-emitting element 40*a* in relation to the first ink mist screen 45*a*. A prism 40*p*2 is disposed at the position occupied by the light-receiving element 40*b* in the first or second embodiment. In addition, the waste ink reservoir 46 is provided with a protective tube 46*a* for transmitting laser light along the passage connecting the prism 40*p*2 and the light-receiving element 40*b*. The rest of the structure is the same as in the second embodiment. In the modified embodiment, the process whereby laser light is emitted by the light-emitting element 40*a* and transmitted to the area above the waste ink reservoir 46 is the same as in the second embodiment. After passing through the area above the waste ink reservoir 46, the laser light is reflected by the prism 40*p*2, transmitted by the protective tube 46*a*, and received by the lens 47 and light-receiving element 40*b*. This arrangement allows the light-emitting element 40*a* and light-receiving element 40*b* to be disposed adjacent to each other and mounted on the same substrate.

C. Third Embodiment

C-1. Device Structure

Figure 15:
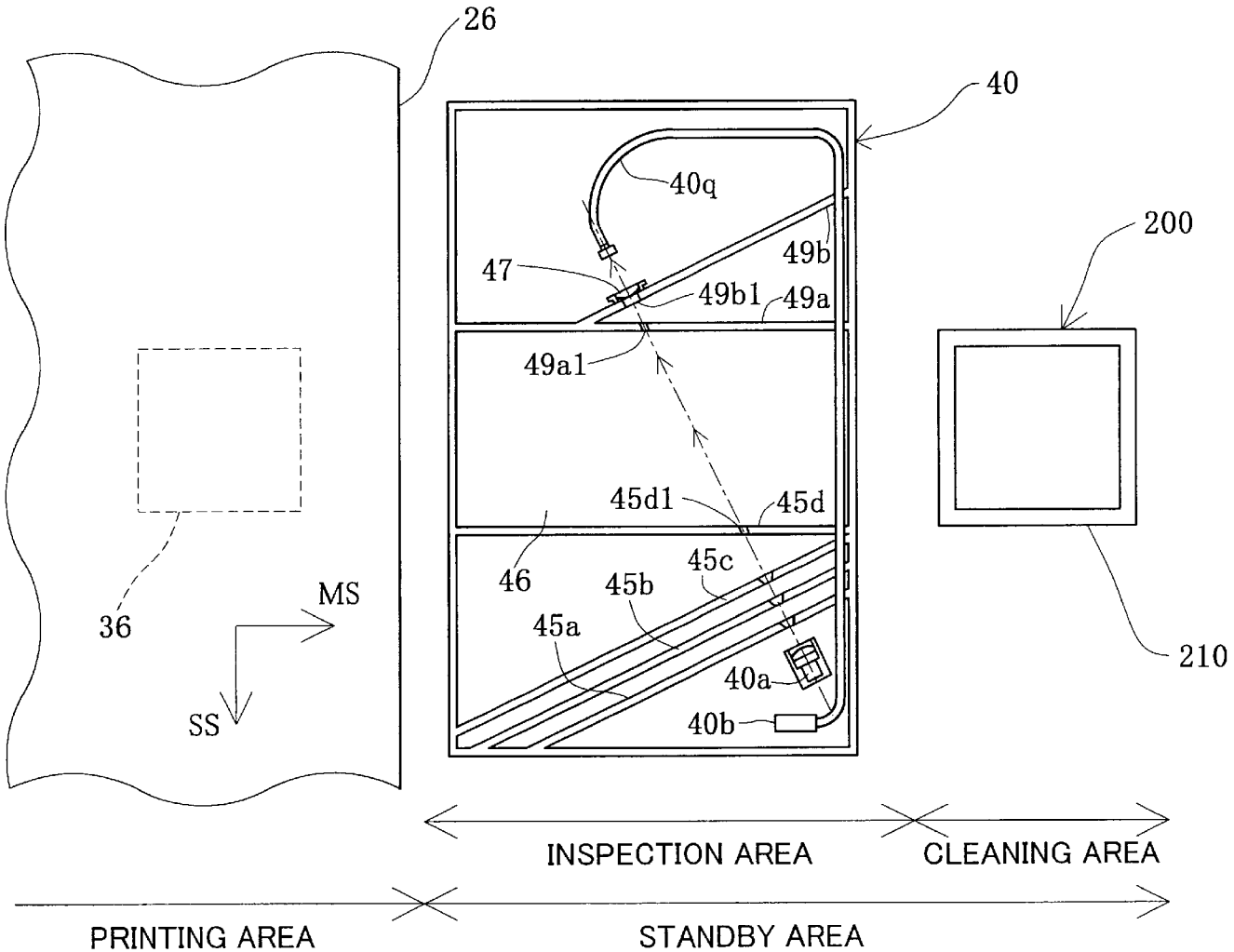
FIG. 15 is a diagram illustrating the dot loss sensor according to a third embodiment.

FIG. 15 is a diagram illustrating the dot loss sensor according to a third embodiment. Here, the light-receiving element 40*b* is disposed adjacent to the light-emitting element 40*a* on the same side of the first ink mist screen 45*a* as the light-emitting element 40*a*. An optical fiber 40*q* is also provided between the reverse side of the lens 47 and the light-receiving element 40*b*. The rest of the structure is the same as in the first embodiment.

C-2. Merits of Third Embodiment

This arrangement allows the light-emitting element 40*a* and light-receiving element 40*b* to be disposed adjacent to each other and mounted on the same substrate. In addition, reflection of light by prisms or mirrors is dispensed with, making it possible to prevent the light reception accuracy of the light-receiving element 40*b* from being affected by the mounting accuracy of the prisms or mirrors. In other words, using the optical fiber 40*q* in accordance with the third embodiment makes it possible to readily and accurately guide laser light toward the light-receiving element 40*b* disposed adjacent to the light-emitting element 40*a* in a direction different from the direction of propagation of laser light emitted by the light-emitting element 40*a*.

D. Fourth Embodiment

D-1. Device Structure

Figure 16:
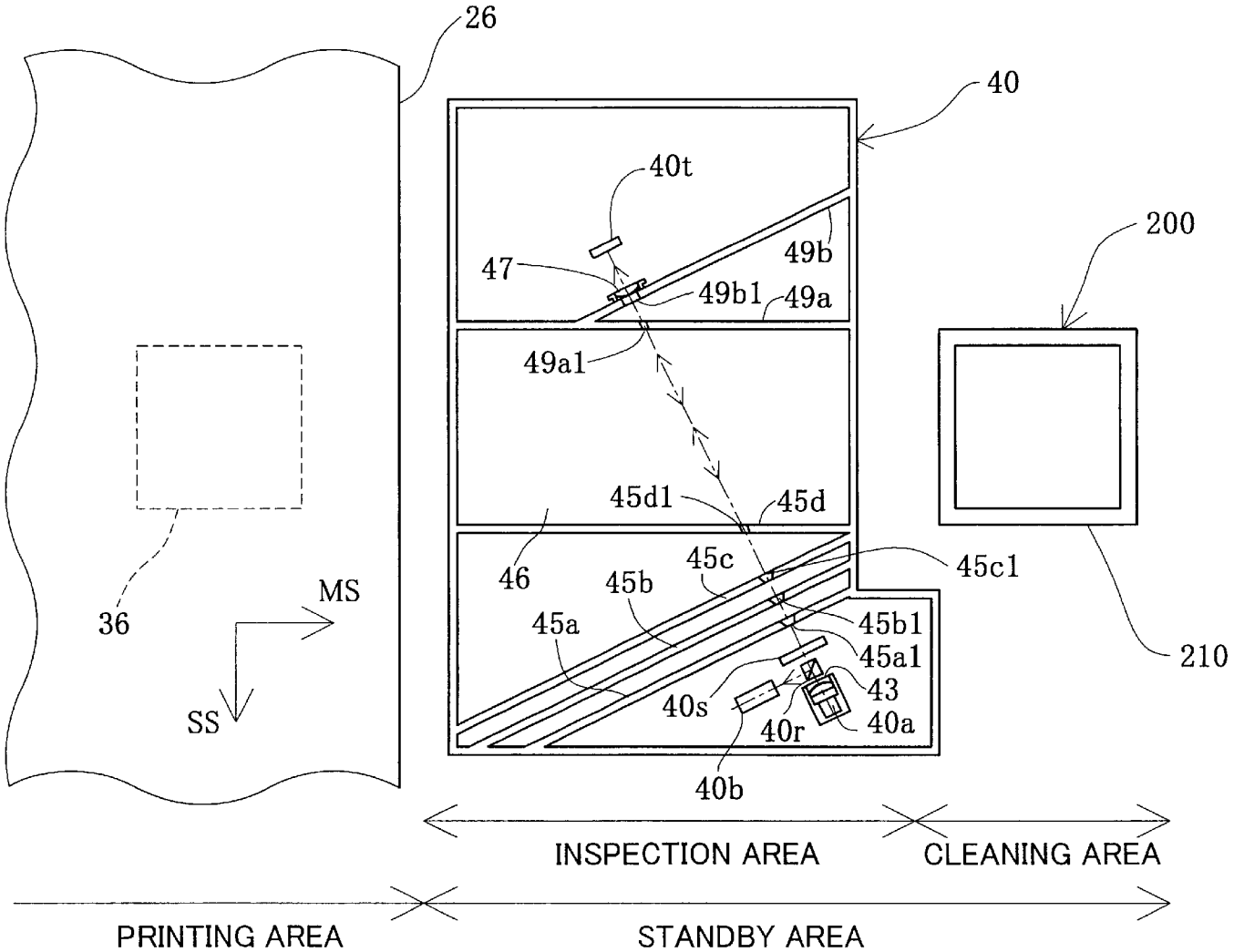
FIG. 16 is a diagram illustrating the dot loss sensor according to a fourth embodiment.

FIG. 16 is a diagram illustrating the dot loss sensor according to a fourth embodiment. Here, a beam splitter 40*r* and a quarter-wave plate 40*s* are disposed in the direction of propagation of laser light between the light-emitting element 40*a* and the first ink mist screen 45*a* in the order indicated. The beam splitter 40*r* has a film for separating polarized light. The beam splitter 40*r* is disposed such that the film for separating polarized light makes an angle of 45 degrees with the optical path of laser light. The light-receiving element 40*b* is disposed on the same side of the first ink mist screen 45*a* as the light-emitting element 40*a* and beam splitter 40*r* at a prescribed position in a direction oriented at 90 degrees in relation to the optical path of the laser light arriving from the polarized light separating film of the quarter-wave plate 40*s*. A mirror 40*t* is also disposed at the position occupied by the light-receiving element 40*b* in the first embodiment. The rest of the structure is the same as in the first embodiment.

Operation of the structural elements used in the fourth embodiment will now be described. Laser light emitted by the light-emitting element 40*a* passes through the lens 41 and aperture plate 43 and reaches the beam splitter 40*r*. Only the polarized component of laser light can pass through the beam splitter 40*r*. The laser light passes through the quarter-wave plate 40*s* and is circularly polarized in the process. The laser light is reflected by the mirror 40*t* and reintroduced into the quarter-wave plate 40*s*. In the process, the laser light becomes linearly polarized light whose plane of polarization differs by 90 degrees from incident light. As a result, the laser light subsequently reaching the beam splitter 40*r* is blocked by the polarized light separating film of the beam splitter 40*r*, reflected by the polarized light separating film in the direction of the light-receiving element 40*b*, and received by the light-receiving element 40*b*.

D-2. Merits of Fourth Embodiment

The arrangement adopted in the fourth embodiment allows the light-emitting element 40*a*, light-receiving element 40*b*, beam splitter 40*r* and quarter-wave plate 40*s* to be mounted on the same side with respect to the area for inspecting ink ejection (area above the waste ink reservoir 46).

D-3. Modification of Fourth Embodiment

Figure 17:
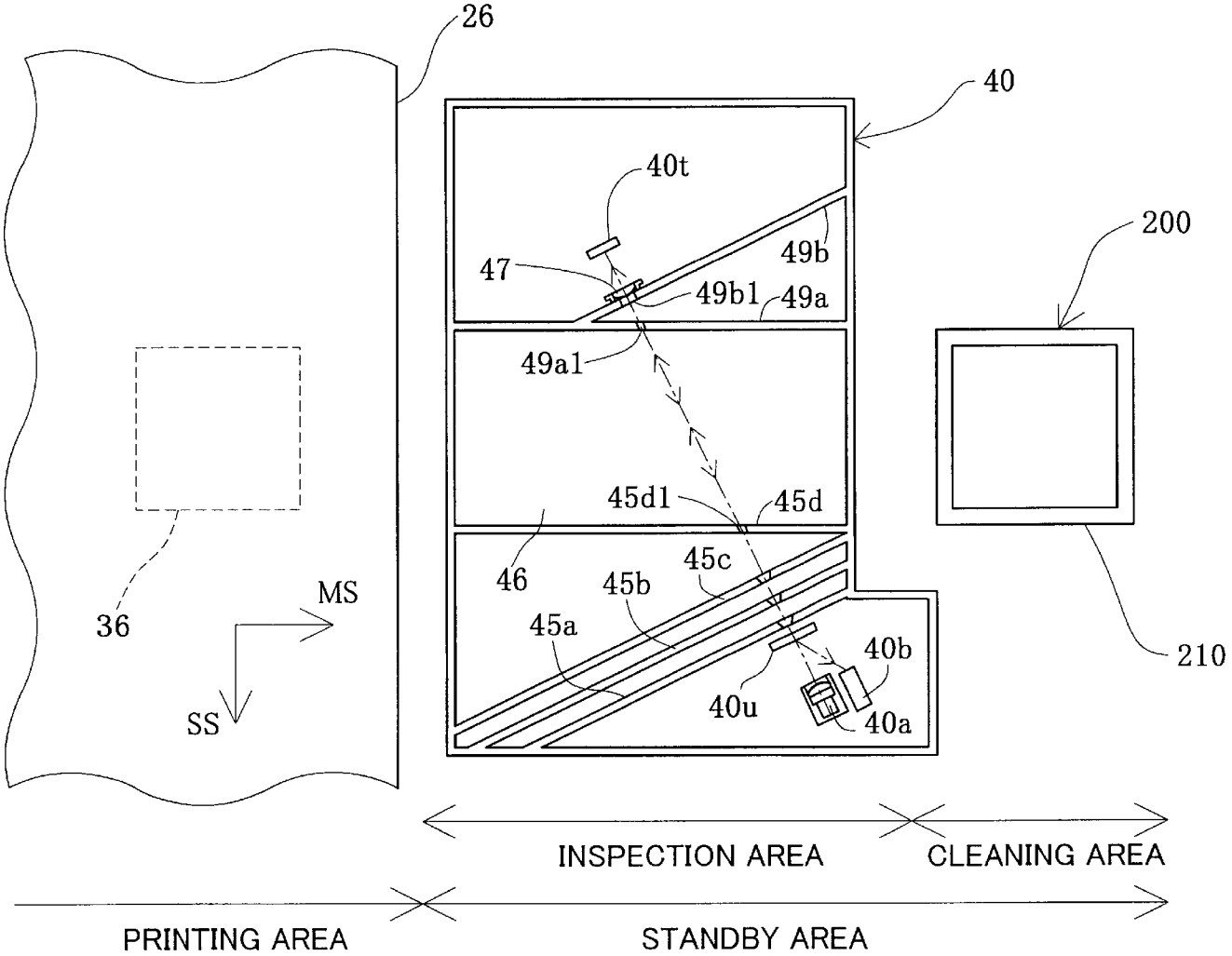
FIG. 17 is a diagram illustrating the dot loss sensor according to a modification of the fourth embodiment.

FIG. 17 is a diagram illustrating the dot loss sensor according to a modification of the fourth embodiment. Here, the beam splitter 40*r* and quarter-wave plate 40*s* used in the fourth embodiment are replaced by a hologram 40*u* disposed at the same position. The light-receiving element 40*b* is disposed adjacent to the light-emitting element 40*a* on the same side of the first ink mist screen 45*a* as the light-emitting element 40*a*. The rest of the structure is the same as in the fourth embodiment. The modified embodiment is similar to the fourth embodiment in that laser light is emitted by the light-emitting element 40*a*, transmitted through the first apertures 45*a*1, 45*b*1, and 45*c*1 of the first ink mist screens 45*a*, 45*b*, and 45*c*, reflected by the mirror 40*t*, and retransmitted through the first aperture 45*a*1 of the first ink mist screen 45*a*. The laser light subsequently reaches the hologram 40*u*. The laser light reflected by the mirror 40*t* is transmitted by the hologram 40*u* while deflected at a prescribed angle not exceeding 90 degrees in relation to its direction of propagation. As a result, the laser light reflected by the mirror 40*t* is received by the light-receiving element 40*b*, which is disposed adjacent to the light-emitting element 40*a*. In common practice, the light-emitting element 40*a*, light-receiving element 40*b*, and hologram 40*u* are referred to collectively as "a hologram laser." For this reason, using a hologram laser in the fourth embodiment makes it possible to simplify the sensor structure and to reduce the number of components.

E. Fifth Embodiment

Figure 18:
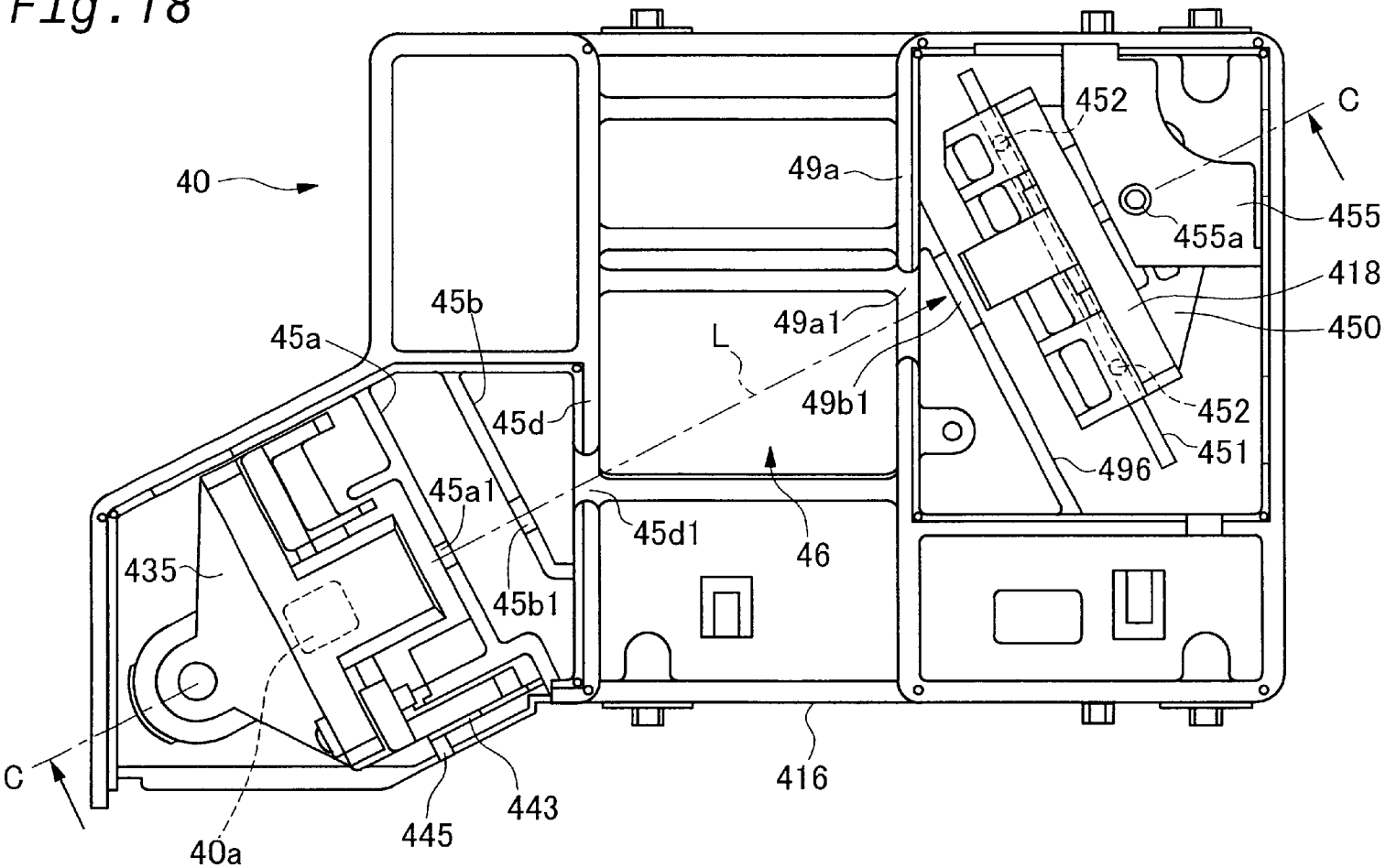
FIG. 18 is a plan view of the dot loss sensor 40 according to a fifth embodiment.

FIG. 18 is a plan view of the dot loss sensor 40 according to a fifth embodiment. While the first to fourth embodiments did not contain any description of the means for adjusting the optical axis of the light-emitting element 40*a* and light-receiving element 40*b*, a specific structure for adjusting the optical axis will be described herein with reference to the fifth embodiment. The printer used in the fifth embodiment has the same structure as the printer 20 used in the first embodiment except for the absence of the first ink mist screen 45*c* of the dot loss sensor 40.

Figure 19:
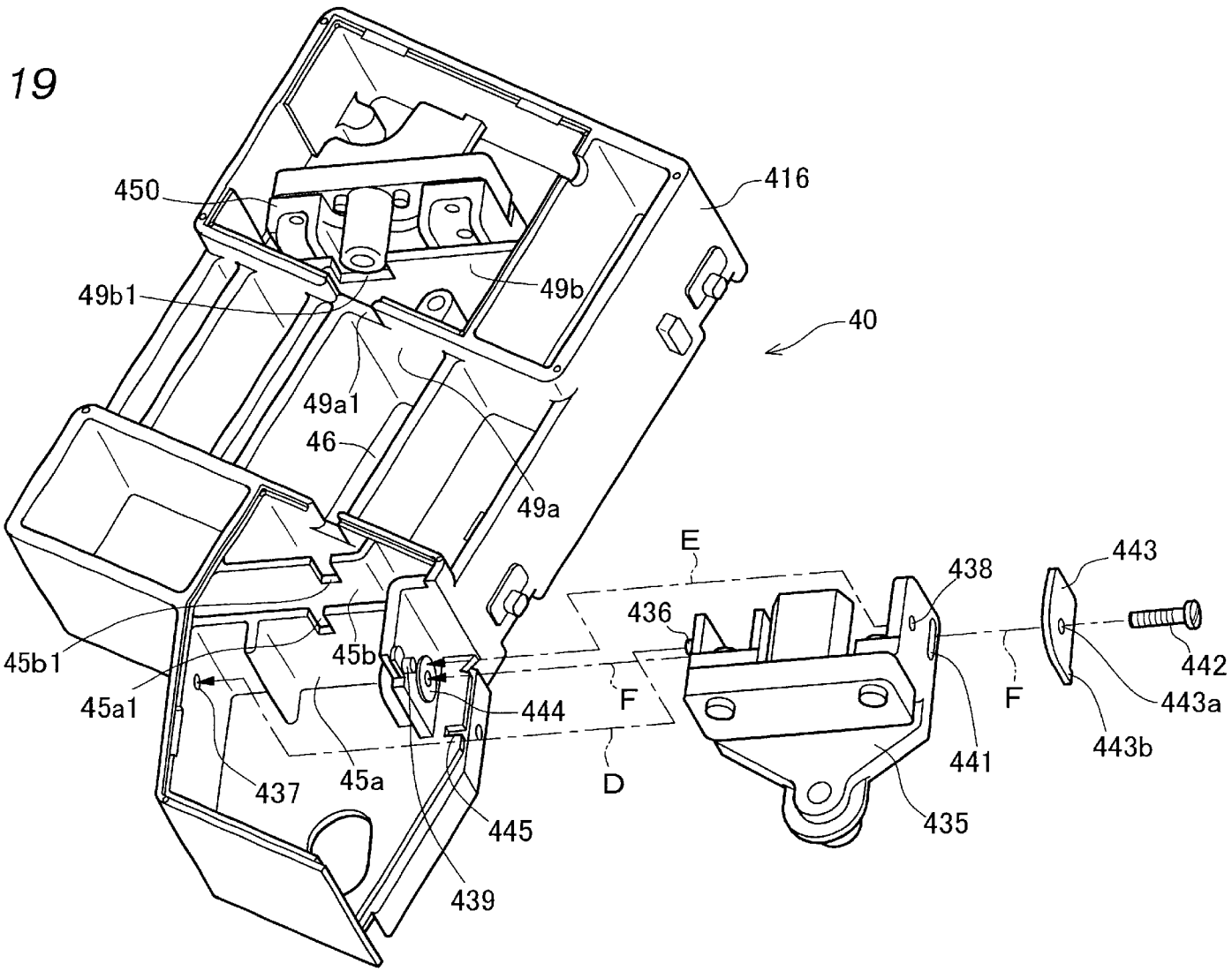
FIG. 19 is an exploded perspective view depicting the structure of the dot loss sensor 40 according to the fifth embodiment.

FIG. 19 is an exploded perspective view depicting the structure of the dot loss sensor 40. The light-emitting element 40*a*, lens 41, and aperture plate 43 are mounted on the holder 435 thereof. A shank (fulcrum shaft) 436 for rotating the holder 435 is provided to one of the lateral distal portions of the holder 435. A through hole 437 for inserting the shank 436 is formed in the casing 416 of the dot loss sensor 40. A through hole 438 intersecting the axial direction of the shank 436 is provided to the other lateral distal portion of the holder 435. The casing 416 is provided with a shank (shaft) 439 inserted into the through hole 438 and designed for rotating the holder 435. The holder 435 provided with the shank 436 and through hole 438, and the casing 416 provided with the through hole 437 and shank 439 correspond to the angle-adjusting element referred to in the claims. On occasion, the light-emitting element 40*a* and holder 435 correspond to the light-emitting element referred to in the claims.

The holder 435 can be mounted in the casing 416 in the manner shown in FIG. 18 when the shank 436 of the holder 435 is positioned facing the through hole 437 of the casing 416 in the manner shown by arrow D in FIG. 19, the through hole 438 of the holder 435 is positioned facing the shank 439 of the casing 416 in the manner shown by arrow E, and the holder 435 is slid in the direction of the arrows. The shank 436 and through hole 438 of the holder 435, and the through hole 437 and shank 439 of the casing 416 are disposed such that the center axes thereof are on the same straight line. These mechanisms are incorporated into the printer such that the center axes thereof are parallel to the nozzle plane of the print head. The "nozzle plane" means a plane on which nozzle openings are formed. For this reason, the angle of the light-emitting element 40*a* (that is, the optical axis of laser light L) can be adjusted in the direction perpendicular to the nozzle plane of the print head. The center axis thereof is also parallel to the horizontal when the printer is disposed in a horizontal plane. The vertical angle of the light-emitting element 40*a* can therefore be adjusted when the printer is disposed in a horizontal plane.

The other lateral distal portion of the holder 435 is provided with a hyperbolic slit 441 whose center coincides with the center of the through hole 438 (that is, the center of the shank 439 for the casing 416). A tightening screw 442 is inserted as a first fixing element into the slit 441 via a through hole 443*a* formed in a first metal plate member. The casing 416 is provided with a screw-receiving member 444 composed of a metal material. The tightening stress generated by the tightening screw 442 is transmitted via the first metal plate member 443 to the holder 435, and the holder 435 is pressed against the casing 416 by the screwing and tightening of the tightening screw 442 in the screw-receiving member 444, as shown by arrow F. The light-emitting element 40*a* is thus mounted in the casing 416. The light-emitting element 40*a* cannot be rotated about the shanks 436 and 439 (the angle cannot be changed).

The angle of the laser light L emitted by the light-emitting element 40*a* is adjusted in advance when the holder 435 is fixed to the casing 416 by the tightening screw 442. A pawl 443*b* extending within the plate surface is provided to the first metal plate member 443. The casing 416 is also provided with a groove 445. The pawl 443*b* is slid along the groove 445 by the tightening of the tightening screw 442, and the first metal plate member 443 is pressed against the holder 435. In other words, the pawl 443*b* functions as a detent. For this reason, the holder 435 (that is, the light-emitting element 40*a*) is not subjected to direct rotation when the tightening screw 442 is tightened, and the preadjusted angle of the light-emitting element 40*a* remains unchanged.

Figure 20:
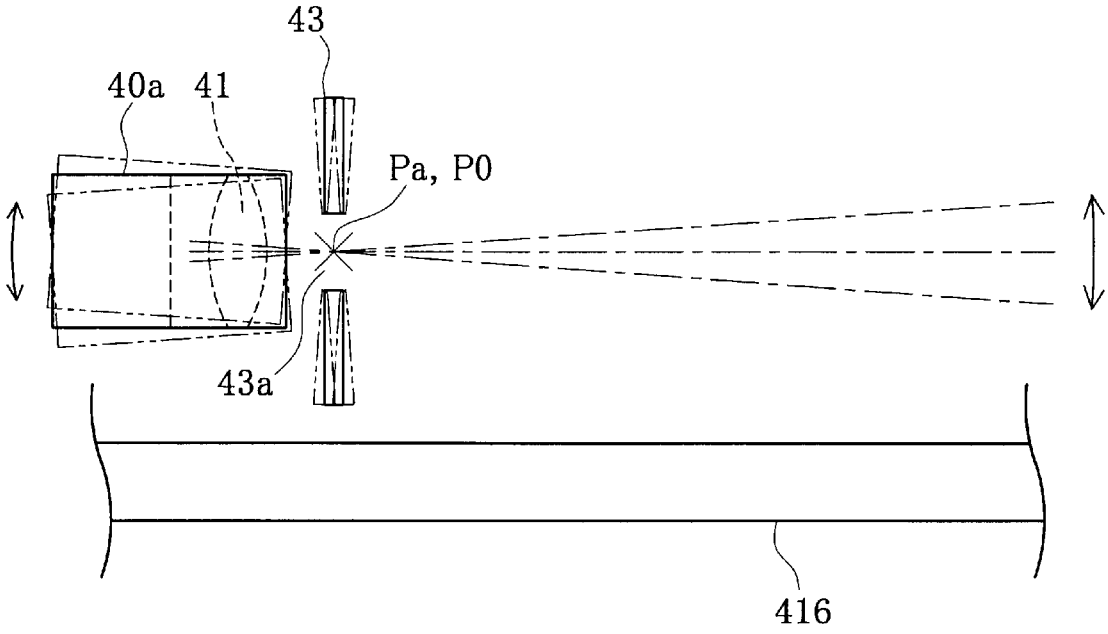
FIG. 20 is a lateral view depicting the relation between the axis of rotation Pa of a holder 435 and the focusing aperture 43*a* of an aperture plate 43.

FIG. 20 is a lateral view depicting the relation between the axis of rotation Pa of the holder 435 and the focusing aperture 43*a* of the aperture plate 43. The light-emitting element 40*a* and aperture plate 43 are disposed such that the optical axis of the laser light L emitted by the light-emitting element 40*a* passes through the center of the focusing aperture 43*a* of the aperture plate 43. The center of the focusing aperture 43*a* is the reference point P0 of incident laser light L. The shank 436 and through hole 438 of the holder 435, and the through hole 437 and shank 439 of the casing 416 are arranged such that the center axis Pa thereof passes through the center of the focusing aperture 43*a* of the aperture plate 43. Consequently, the reference point P0 of incident laser light L emitted by the light-emitting element 40*a* coincides with the center of rotation Pa when the emission angle of laser light L is adjusted. For this reason, the reference point P0 of incident laser light remains immovable about the center axis Pa when the light-emitting element 40*a* is oriented at varying angles (laser light L emitted at varying angles). The direction in which the optical axis of laser light L is oriented varies somewhat depending on the accuracy of assembling the light-emitting element 40*a*, lens 41, and aperture plate 43 in the holder 435. It is, however, possible to prevent laser light L from being blocked by the first ink mist screen 45*a*, 45*b*, or 45*d* if the dimensions of the first apertures 45*a*1, 45*b*1, and 45*d*1 in the first ink mist screens 45*a*, 45*b*, and 45*d* are set with consideration for such variations.

Figure 21:
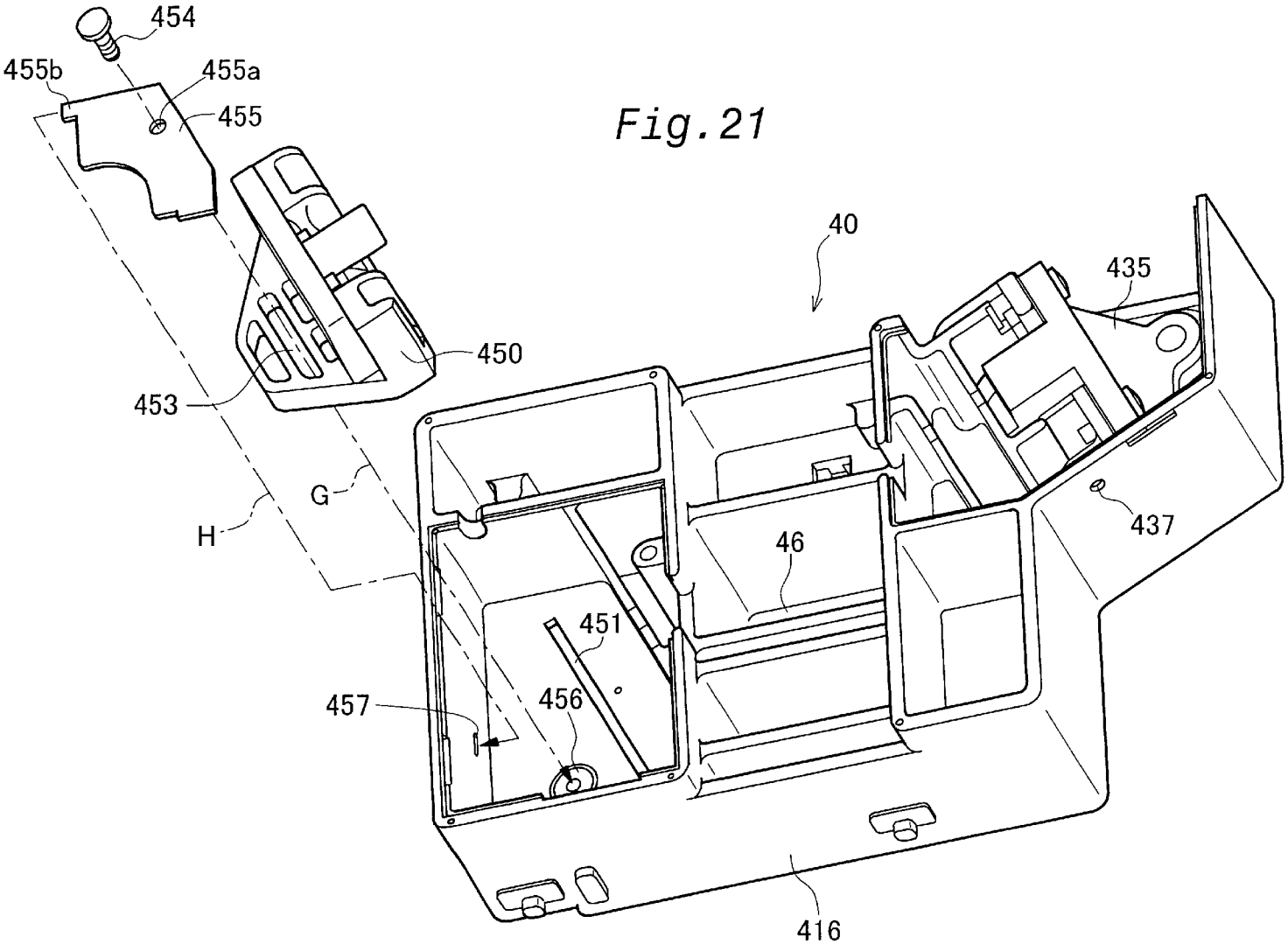
FIG. 21 is an exploded perspective view depicting the structure of the dot loss sensor 40 according to the fifth embodiment.

FIG. 21 is an exploded perspective view depicting the structure of the dot loss sensor 40. The light-receiving element 40*b* is mounted on a holder 450. A rectilinear groove 451 is formed in the bottom of a casing 416 that houses the holder 450. The groove 451 lies in a plane orthogonal to the optical axis of laser light L extending from the light-emitting element 40*a* to the light-receiving element 40*b*. The groove 451 is horizontal when the printer is disposed in a horizontal plane. The bottom surface of the holder 450 is provided with two protrusions 452 (see FIG. 18). These protrusions are inserted into the groove 451 and are caused to slide inside the groove 451 when the holder 450 is slid along the groove 451.

The two protrusions 452 are disposed at a distance from each other on the bottom surface of the holder 450. These protrusions 452 are fitted into the groove 451 when the holder 450 is incorporated into the casing 416. The holder 450 is slid such that the two protrusions 452 move inside the groove 451. For this reason, the holder 450 (light-receiving element 40*b*) can slide along the groove 451 while maintaining a constant orientation without rotating relative to the groove 451. The holder 450 provided with the two protrusions 452, and the casing 416 provided with the groove 451 correspond to the position-adjusting element referred to in the claims. The holder 450 is also provided with a rectilinear slit 453, as shown in FIG. 21. A tightening screw 454 is inserted as a second fixing element into the slit 453 via a through hole 455*a* formed in a second metal plate member.

The casing 416 is provided with a screw-receiving member 456 composed of a metal material. The tightening stress generated by the tightening screw 454 is transmitted via the second metal plate member 455 to the holder 450, and the holder 450 is pressed against the bottom surface of the casing 416 by the screwing of the tightening screw 454 into the screw-receiving member 456, as shown by arrow G. The light-receiving element 40*b* is thus mounted in the casing 416. Collectively, the light-receiving element 40*b* and holder 450 may correspond to the light-receiving element referred to in the claims.

When the light-receiving element 40*b* is fixed to the casing 416 by the tightening screw 454, the light-receiving element 40*b* is brought to a position in which laser light L emitted by the light-emitting element 40*a* can be efficiently received by the light-receiving element 40*b* (FIG. 18). A pawl 455*b* extending within the plate surface is provided to the second metal plate member 455. The tightening screw 454 is tightened in a state in which the pawl 455*b* fits into a concavity 457 formed in the inner wall of the casing 416, as shown by arrow H.

Because the pawl 455*b* fits into the concavity 457, the second metal plate member 455 is not rotated in the tightening direction of the tightening screw 454 by the tightening of the tightening screw 454. The tightening stress produced by the tightening screw 454 acts to press the holder 450 against the bottom surface of the casing 416. For this reason, the light-receiving element 40*b* remains immovable relative to the casing 416 when the position thereof has been adjusted.

In this arrangement, the optical axis of light traveling from a light-emitting element to a light-receiving element can be easily aligned by adjusting the position of the light-receiving element and the angle at which laser light is emitted by the light-emitting element.

When two-dimensional adjustment mechanisms needed to adjust the optical axis are provided either to the light-emitting element or to the light-receiving element, the element provided with the adjustment mechanism increases in size. However, the fifth embodiment allows both the light-emitting element and the light-receiving element to be miniaturized because the two-dimensional adjustment mechanisms for vertical and horizontal directions are divided between the light-emitting and light-receiving elements. In addition, light-emitting and light-receiving elements having peripheral devices are difficult to assemble when the light-emitting element and the light-receiving element both need to be adjusted in two directions. By contrast, the fifth embodiment requires only one direction to be adjusted for the light-emitting element and light-receiving element, making mounting operations easier to accomplish when light-emitting and light-receiving assemblies having adjustment mechanisms are involved.

In the fifth embodiment, the optical axis of laser light can be adjusted parallel to the nozzle plane because the angle-adjusting mechanism for adjusting the angle of the optical axis within the plane perpendicular to the nozzle plane is provided on the side of the light-emitting element (see FIG. 4). The angle of the optical axis can therefore be adjusted such that the distance between a nozzle and the optical axis is the same for all nozzles when the trajectories of ink droplets ejected by each nozzle intersect the optical path (see FIGS. 4 and 5). The ejection of ink droplets from each nozzle can therefore be inspected under the same conditions.

Although the fifth embodiment was described with reference to a case in which the light-emitting element 40*a* and light-receiving element 40*b* are mounted on holders 435 and 450 fashioned as separate members, the light-emitting element 40*a* and holder 435 can also be integrated together, as can the light-receiving element 40*b* and holder 450.

F. Other

Figure 23:
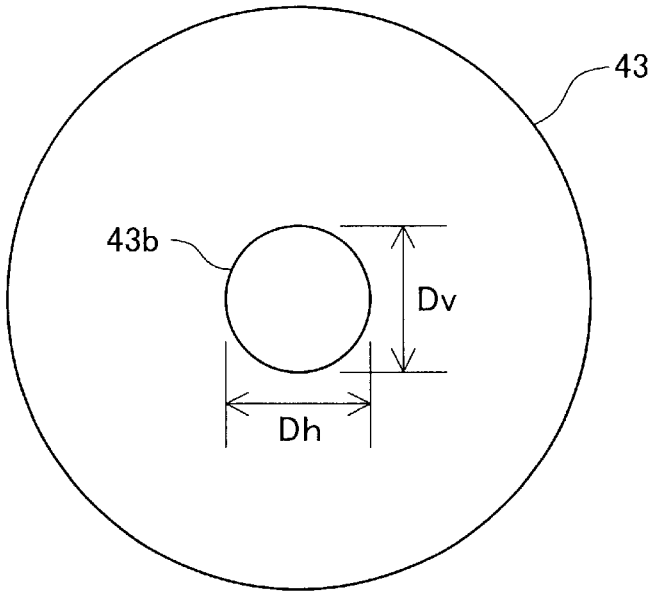
FIG. 23 is diagrams illustrating the profiles of the aperture 43*b* of the aperture plate 43.
Figure 24:
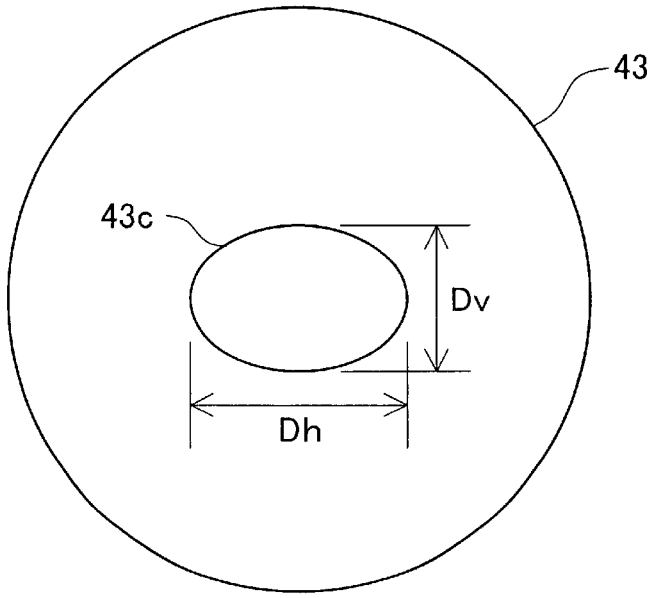
FIG. 24 is diagrams illustrating the profiles of the aperture 43*c* of the aperture plate 43.
Figure 25:
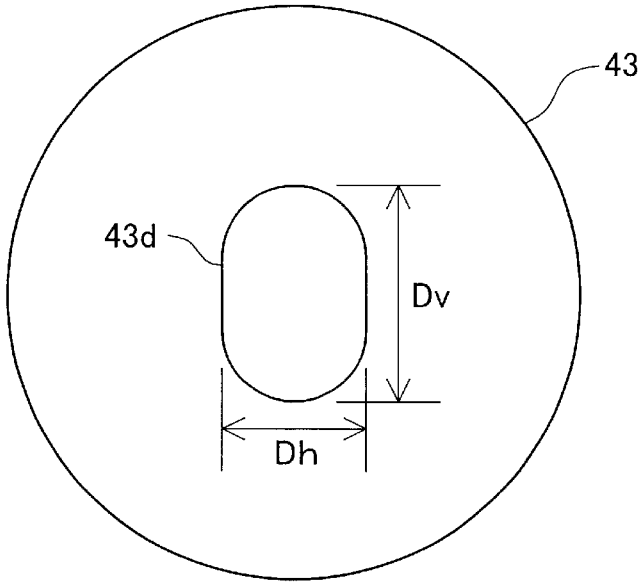
FIG. 25 is diagrams illustrating the profiles of the aperture 43*d* of the aperture plate 43.

FIGS. 23 to 25 are diagrams illustrating the profiles of the apertures 43*b* to 43*d* of the aperture plate 43. These are the figures for showing the examples of the profile of the aperture and the dimensional ratio of the aperture to the aperture plate does not reflect the actual ratio. It is preferable that the profile of aperture is substantially circular. The term "substantially circular" means that the horizontal dimension Dh is within 75% to 125% of the vertical dimension Dv. It is preferable for the dot loss sensor 40 that the horizontal dimension Dh is within 85% to 115% of the vertical dimension Dv. More preferably the horizontal dimension Dh is within 90% to 110% of the vertical dimension Dv. The profile of the aperture may be circle as illustrated in FIG. 23. The profile of the aperture may also be ellipse or oval as illustrated in FIG. 24 or FIG. 25.

Figure 26:
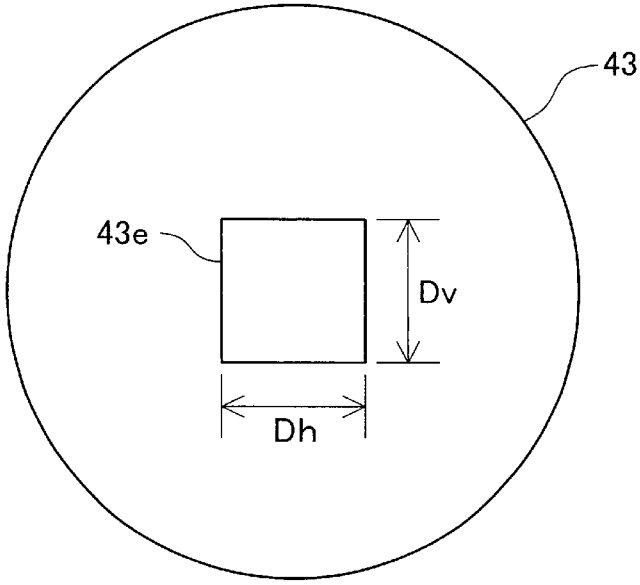
FIG. 26 is diagrams illustrating the profiles of the aperture 43*e* of the aperture plate 43.
Figure 27:
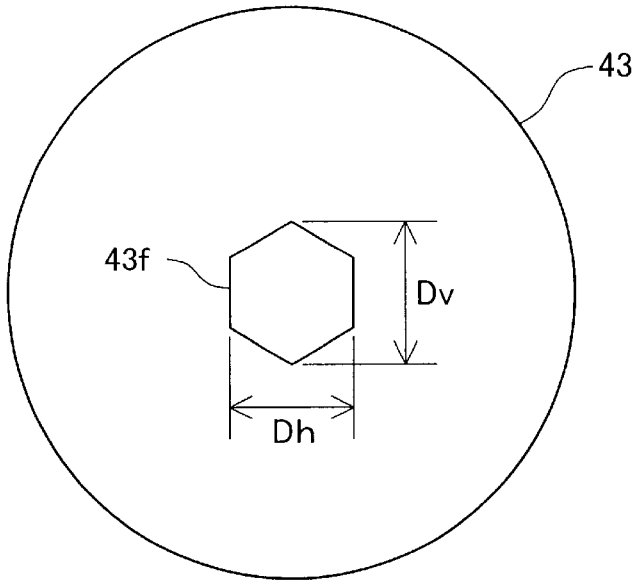
FIG. 27 is diagrams illustrating the profiles of the aperture 43*f* of the aperture plate 43.
Figure 28:
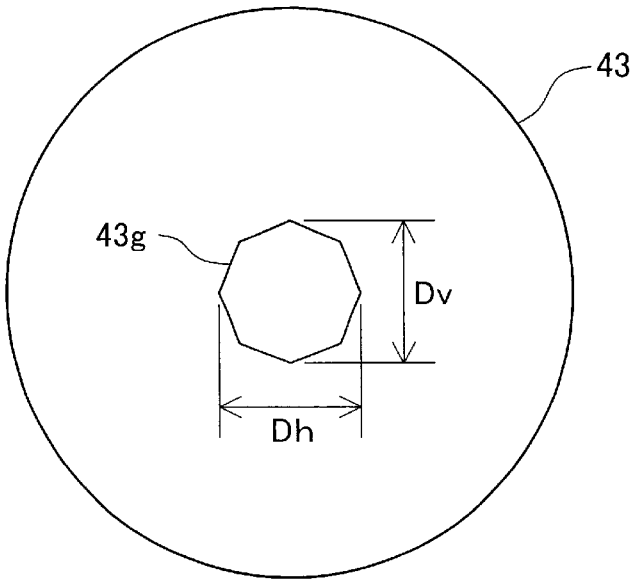
FIG. 28 is diagrams illustrating the profiles of the aperture 43*g* of the aperture plate 43.

FIGS. 26 to 28 are diagrams illustrating the profiles of the apertures 43*e* to 43*g* of the aperture plate 43. The dimensional ratio of the aperture to the aperture plate does not reflect the actual ratio. The profile of aperture may be regular polygonal as illustrated in FIGS. 26 to 28. FIG. 26 shows the square aperture 43*e*. FIG. 27 shows the hexagon aperture 43*e*. FIG. 28 shows the octagon aperture 43*e*. It is preferable that the profile of aperture is regular polygonal having four or more angles. More preferably, the profile of aperture is regular polygonal having six or more angles.

These apertures having substantially circular or regular polygonal profiles can make the cross-section of the detection light substantially circular. With such the detection light, the intensity of the light varies much when the ink droplet passes it. Accordingly, the light-receiving element 40*b* can easily detect the passing of the ink droplet and the accuracy of the ink detection increases.

The above embodiments were described with reference to cases in which the present invention was adapted to a color printer, but monochromatic printers can also be operated using this invention. In the printers in accordance with the above embodiments, the dot loss sensors were mounted only on one side of the printing area, but the present invention can also be adapted to printers in which the dot loss sensors are provided on both sides of the printing area. It is also possible to use printers for printing images on A0-size media, B0-size media, and other types of large print media. Because considerable time is needed to print images on a single sheet of print medium in a printer for large print media, the downtime for print resetting can be considerable when dot loss occurs due to nozzle clogging during printing. The downtime resulting from print resetting can therefore be markedly reduced by employing the present invention to accurately inspect the ejection of ink droplets and to promptly detect a non-operating nozzle.

Figure 22:
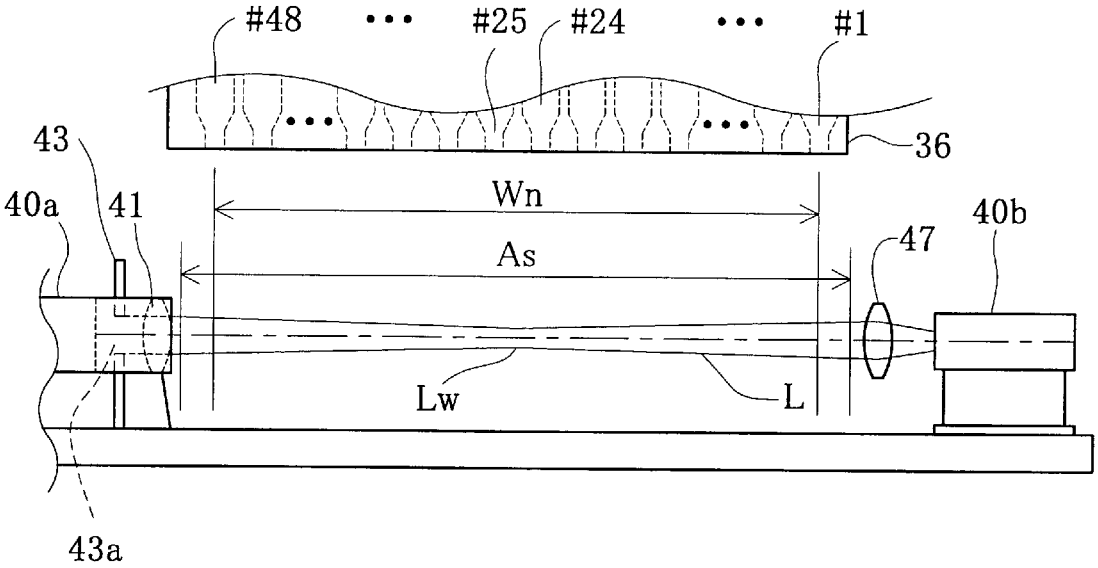
FIG. 22 is a diagram illustrating the manner in which the aperture plate 43 and lens 41 are arranged in accordance with a modified embodiment.

FIG. 22 is a diagram illustrating the manner in which the aperture plate 43 and lens 41 are arranged in accordance with a modified embodiment. Whereas in the above embodiments the lens 41 was disposed between the light-emitting element 40*a* and aperture plate 43, it is also possible to dispose the aperture plate 43 between the light-emitting element 40*a* and lens 41, as shown in FIG. 22.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer for printing images by ejecting ink droplets from a plurality of nozzles, comprising:

a print head having a plurality of nozzles; and a sensor including a light-emitting element configured to emit detection light which has a substantially circular cross-section and a light-receiving element configured to receive the detection light, and configured to inspect operation of a nozzle by determining whether the detection light has been blocked by the ink droplets ejected by the nozzle, the sensor further comprising:

a first condensing element configured to condense the detection light; and an apertured element having a substantially circular aperture for the detection light, the aperture having a size of a same order as the cross-section of the detection light, wherein the detection light intersects an ejecting path of the ink droplets at an exit side of the apertured element and the first condensing element.

2. A printer in accordance with claim 1, wherein the apertured element is disposed at an exit side of the first condensing element.

3. A printer in accordance with claim 1, wherein the first condensing element is disposed at an exit side of the aperture of the apertured element.

4. A printer in accordance with claim 1, wherein the sensor further comprises an angle-adjusting element configured to adjust a direction of emission of the detection light.

5. A printer in accordance with claim 4, wherein the sensor further comprises a position-adjusting element configured to adjust a position of the light-emitting element in a direction intersecting the direction of emission of the detection light.

6. A printer in accordance with claim 5, wherein the plurality of nozzles are disposed on a same nozzle plane of the print head; and the angle-adjusting element is configured to adjust the direction of emission of the detection light within a plane perpendicular to the nozzle plane.

7. A printer in accordance with claim 5, wherein the angle-adjusting element adjusts the direction of emission of the detection light about an axis intersecting an optical path of the detection light within confines of the aperture.

8. A printer in accordance with claim 1, wherein the sensor further comprises a first ink mist screen having a first aperture for the detection light, disposed at an exit side of the first condensing element and the apertured element, the first ink mist screen dividing a first area including the light-emitting element, the first condensing element, and the apertured element, and a second area in which the ink droplets are ejected in a direction of an optical path of the detection light.

9. A printer in accordance with claim 8, comprising a plurality of the first ink mist screens.

10. A printer in accordance with claim 1, wherein the sensor further comprises a second condensing element disposed at an exit side of the first condensing element and the apertured element, the second condensing element having a light reception region with a prescribed surface area, the second condensing element focusing the detection light received in the light reception region, the detection light intersects an ejecting path of the ink droplets at an incident side of the second condensing element.

11. A printer in accordance with claim 10, wherein the sensor further comprises a second ink mist screen having a second aperture for the detection light, disposed at an exit side of the first condensing element and the apertured element, the second ink mist screen dividing a first area including the light-receiving element and the second condensing element, and a second area in which the ink droplets are ejected in a direction of an optical path of the detection light.

12. A printer in accordance with claim 11, comprising a plurality of the second ink mist screens.

13. A printer in accordance with claim 1, wherein the light-emitting element is mounted on a base member such that a vertical angle of the detection light can be adjusted;

the light-receiving element is mounted on the base member to be able to move horizontally; and the printer further comprises a first fixing element fixing the light-emitting element to the base member at an adjusted angle; and a second fixing element fixing the light-receiving element to the base member at a prescribed horizontal movement position.

14. A printer in accordance with any of claims 13, wherein the light-emitting element is mounted on the base member such that the vertical angle of the detection light can be adjusted about a fulcrum shaft formed in a horizontal direction; and the fulcrum shaft is formed at a position in which an axis of the fulcrum shaft intersects the aperture of the apertured element.

15. A printer in accordance with claim 14, wherein a slide mechanism is formed between the light-receiving element and the base member, the slide mechanism has a groove formed in the horizontal direction and a protrusion configured to slide inside the groove; and the light-receiving element is mounted by means of the slide mechanism to be able to move horizontally in relation to the base member.

16. A printer in accordance with claim 15, wherein the protrusion is formed at two locations set apart from each other.

17. A printer for printing images by ejecting ink droplets from a plurality of nozzles, comprising:

a print head having a plurality of nozzles; and a sensor including a light-emitting element configured to emit detection light which has a substantially circular cross-section and a light-receiving element configured to receive the detection light, and configured to inspect operation of a nozzle by determining whether the detection light has been blocked by the ink droplets ejected by the nozzle, the sensor further comprising:

a first condensing element configured to condense the detection light; and an apertured element having a regular polygonal aperture having four or more angles for the detection light, the aperture having a size of a same order as the cross-section of the detection light, wherein the detection light intersects an ejecting path of the ink droplets at an exit side of the apertured element and the first condensing element.

18. A printer in accordance with claim 17, wherein the apertured element comprises the regular polygonal aperture having six or more angles.

19. A method for detecting a non-operating nozzle in a printer for printing images by ejecting ink droplets from a plurality of nozzles, comprising the steps of:

(a) providing a light-emitting element configured to emit detection light which has a substantially circular cross-section, a first condensing element configured to condense the detection light, an apertured element having a substantially circular aperture for the detection light, and a light-receiving element configured to receive the detection light after the detection light intersects a path of the ink droplets ejected by a nozzle, the aperture having a size of a same order as the cross-section of the detection light;

(b) emitting the detection light from the light-emitting element;

(c) ejecting ink droplets from a nozzle; and (d) detecting a non-operating nozzle by determining whether the detection light received by the light-receiving element has been blocked by the ink droplets.

20. A method for detecting a non-operating nozzle in accordance with claim 19, wherein the plurality of nozzles are disposed on a same nozzle plane of the print head; and the step (a) includes a step of adjusting a direction of emission of the detection light within a plane perpendicular to the nozzle plane.

21. A method for detecting a non-operating nozzle in accordance with claim 19, wherein the step (a) includes a step of adjusting a direction of emission of the detection light about an axis intersecting an optical path of the detection light within confines of the aperture of the apertured element.

22. A method for detecting a non-operating nozzle in accordance with claim 19, wherein the printer further comprises a second condensing element disposed at an exit side of the first condensing element and the apertured element, the second condensing element having a light reception region with a prescribed surface area, the second condensing element focusing the detection light received in the light reception region; and the step (c) includes a step of making the detection light to intersect an ejecting path of the ink droplets at an incident side of the second condensing element.

23. A method for detecting a non-operating nozzle in accordance with claim 19, wherein the step (a) includes:

(a1) a step of adjusting a vertical angle of the detection light and fixing the light-emitting element to a base member at the angle adjusted; and (a2) a step of moving the light-receiving element in a horizontal direction to achieve a positional adjustment, and fixing the light-receiving element to the base member at a position adjusted.

24. A method for detecting a non-operating nozzle in accordance with claim 23, wherein the step (a1) includes a step of adjusting the vertical angle of the detection light about a fulcrum shaft whose axis is at a position intersecting the aperture of the apertured element.

25. A method for detecting a non-operating nozzle in a printer for printing images by ejecting ink droplets from a plurality of nozzles, comprising the steps of:

(a) providing a light-emitting element configured to emit detection light which has a substantially circular cross-section, a first condensing element configured to condense the detection light, an apertured element having a regular polygonal aperture having four or more angles for the detection light, and a light-receiving element configured to receive the detection light after the detection light intersects a path of the ink droplets ejected by a nozzle, the aperture having a size of a same order as the cross-section of the detection light;

(b) emitting the detection light from the light-emitting element;

(c) ejecting ink droplets from a nozzle; and (d) detecting a non-operating nozzle by determining whether the detection light received by the light-receiving element has been blocked by the ink droplets.

26. A method for detecting a non-operating nozzle in accordance with claim 25, wherein the apertured element comprises the regular polygonal aperture having six or more angles.

* * * * *